US010159986B2

(12) United States Patent
Lee et al.

(10) Patent No.: US 10,159,986 B2
(45) Date of Patent: Dec. 25, 2018

(54) FOOD WASTE TREATMENT APPARATUS AND DISCHARGE UNIT OF FOOD WASTE TREATMENT APPARATUS

(71) Applicant: LG ELECTRONICS INC., Seoul (KR)

(72) Inventors: Sunki Lee, Seoul (KR); Daeyun Park, Seoul (KR); Jongseok Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 574 days.

(21) Appl. No.: 14/800,857

(22) Filed: Jul. 16, 2015

(65) Prior Publication Data

US 2016/0017582 A1 Jan. 21, 2016

(30) Foreign Application Priority Data

Jul. 16, 2014 (KR) ..... 10-2014-0090067

(51) Int. Cl.

| | |
|---|---|
| ***B02C 23/10*** | (2006.01) |
| ***B02C 23/20*** | (2006.01) |
| ***E03C 1/266*** | (2006.01) |
| ***B02C 18/00*** | (2006.01) |
| ***B02C 18/14*** | (2006.01) |

(Continued)

(52) U.S. Cl.

CPC ..... *B02C 18/0092* (2013.01); *B02C 18/142* (2013.01); *B02C 18/182* (2013.01); *B02C 18/2216* (2013.01); *B02C 23/10* (2013.01); *B02C 23/20* (2013.01); *E03C 1/266* (2013.01); *E03C 1/2665* (2013.01)

(58) Field of Classification Search

CPC ..... E03C 1/266; E03C 1/2665; B02C 23/10; B02C 23/20; B02C 18/0092; B02C 18/142; B02C 18/182; B02C 18/2216; B02C 18/0084

USPC ..... 241/46.013, 101.8, 65

See application file for complete search history.

(56) References Cited

U.S. PATENT DOCUMENTS 2,148,447 A * 2/1939 Dundas ..... C02F 11/12 110/193
2,148,981 A * 2/1939 Dundas ..... C02F 11/12 110/222

(Continued)

FOREIGN PATENT DOCUMENTS

JP H10-165930 6/1998
JP H11-019629 1/1999

(Continued)

*Primary Examiner* — Jessica Cahill
*Assistant Examiner* — Smith O Bapthelus
(74) *Attorney, Agent, or Firm* — Fish & Richardson P.C.

(57) ABSTRACT

A food waste treatment apparatus is described. The apparatus includes a housing that defines a space that is configured to dehydrate and dry food waste, the housing having a drain pipe that is configured to discharge water included in the food waste and an exhaust duct that is configured to exhaust air that dried the food waste. The apparatus further includes a dryer that is configured to dry the food waste by supplying dry air to the housing. The apparatus further includes an exhaust unit connected to the drain pipe and the exhaust duct, the exhaust unit being configured to prevent the air exhausted from the exhaust duct from flowing back into the drain pipe.

16 Claims, 16 Drawing Sheets

(51) Int. Cl.
*B02C 18/18* (2006.01)
*B02C 18/22* (2006.01)

(56) References Cited

U.S. PATENT DOCUMENTS 3,366,339 A * 1/1968 Fair ..... E03F 3/00
241/101.5
3,376,718 A * 4/1968 Kahn ..... D06F 13/00
34/87
4,072,273 A * 2/1978 Reiniger ..... B02C 13/14
241/19
7,240,865 B2 * 7/2007 Choi ..... A61L 11/00
241/100
7,954,739 B2 * 6/2011 Shin-Ya ..... B02C 18/0084
241/100
8,782,824 B2 * 7/2014 Shoop ..... E03C 1/232
4/539

FOREIGN PATENT DOCUMENTS

JP 2002-011446 1/2002
JP 3629734 3/2005
JP 2007-303798 11/2007

* cited by examiner

FOOD WASTE TREATMENT APPARATUS AND DISCHARGE UNIT OF FOOD WASTE TREATMENT APPARATUS

CROSS REFERENCE TO RELATED APPLICATION

Pursuant to 35 U.S.C. § 119(a), this application claims the benefit of Korean Patent Application No. 10-2014-0090067, filed on Jul. 16, 2014, which is hereby incorporated by reference as if fully set forth herein.

FIELD

The present disclosure relates to a portable food waste treatment apparatus.

BACKGROUND

Among methods to treat food waste generated in a kitchen, there is a method in which a drain in a sink is equipped with a garbage disposal unit to allow food waste discharged from the drain to be shredded prior to passing through plumbing.

The conventional garbage disposal unit as described above is configured to grind food waste introduced, along with water, through the sink's drain into small pieces using grinding blades thereof. The ground food waste may be discharged separately, or may pass through plumbing along with waste water.

A conventional food waste treatment apparatus further has a drying function of removing moisture contained in ground food waste, in order to reduce the weight of the food waste. The food waste treatment apparatus having the drying function needs to perform an additional process of treating air used to dry the food waste prior to discharging the same into a room.

SUMMARY

According to an innovative aspect of the subject matter described in this application, a food waste treatment apparatus includes a housing that defines a space that is configured to dehydrate and dry food waste, the housing having a drain pipe that is configured to discharge water included in the food waste and an exhaust duct that is configured to exhaust air that dried the food waste; a dryer that is configured to dry the food waste by supplying dry air to the housing; and an exhaust unit connected to the drain pipe and the exhaust duct, the exhaust unit being configured to prevent the air exhausted from the exhaust duct from flowing back into the drain pipe.

The food waste treatment apparatus may include one or more of the following optional features. The exhaust unit includes an exhaust body that defines a space that is configured to allow air and water to pass through the exhaust body; and a partition configured to divide the space of the exhaust body into a first space and a second space, the partition defining a gap that is configured to allow water to flow below the partition. The first space includes a water inlet port that is configured to connect to the drain pipe. The second space includes an outlet port that is configured to discharge water, the water inlet port being located at a higher position relative to the gap than the outlet port. The second space includes an air inlet port that is located at a top of the second space and is configured to connect to the exhaust duct. The exhaust duct includes a check valve that is configured to prevent air moving through the exhaust duct from flowing back through an inlet of the exhaust duct. An air inlet port is located above the outlet port and is configured to be blocked from allowing air to pass to the outlet port based on water being in the second space.

The exhaust duct includes a check valve that is configured to prevent air moving through the exhaust duct from flowing back through an inlet of the exhaust duct. The exhaust duct includes a shielding chamber that is configured to block a flow path of air exhausted through the exhaust duct by supplying additional water to the shielding chamber. The shielding chamber includes a water supply pipe that is configured to supply water to the shielding chamber, a second drain pipe that is configured to guide water in the shielding chamber to the drain pipe, and a drain valve that is connected to the second drain pipe and is configured to control the second drain pipe. The exhaust duct and the second drain pipe are located at a top of the shielding chamber. The exhaust duct and the second drain pipe are configured to be blocked based on water being in the shielding chamber. The shielding chamber includes a water level sensor located at the top of the shielding chamber. A bottom of the shielding chamber is sloped towards the second drain pipe.

The apparatus includes a grinder located between a drain and the housing, the grinder being configured to grind the food waste and provide the food waste to the housing. The grinder includes a support body that includes an introduction side that is configured to receive the food waste and a discharge side that is configured to discharge the food waste to the housing; and a pair of rotary cutters that is rotatably installed to the support body, the pair of rotary cutters being configured to grind the food waste received through the introduction side and to move the food waste to the discharge side. The housing includes a cylindrical housing body that is configured to be oriented parallel with ground upon proper installation; an inlet port that is configured to guide the food waste discharged from the grinder to the cylindrical housing body; and an outlet port that is configured to discharge food waste that has been dehydrated and dried. The apparatus includes a dehydrator configured to remove water included in the food waste by spinning the food waste inside the housing.

The dehydrator includes a storage body that is rotatably installed in the housing, the storage body having a communication hole that is configured to connect with the inlet port for receiving the food waste or the outlet port for discharging food waste based on an orientation of the storage body; and a rotating shaft that is configured to rotatably connect the storage body with the housing body. The apparatus includes an agitator that is located in the storage body, that is configured to rotate independent of the storage body, that is configured to open and close the communication hole of the storage body, and that is configured to agitate the food waste by rotating. The apparatus includes a drive unit that is configured to rotate the agitator in a clockwise direction and a counterclockwise direction. The storage body rotates along with the agitator based on the agitator being rotated in one direction among the clockwise direction and the counterclockwise direction.

The agitator includes a base that is located inside the storage body and that is configured to rotate a door blade extending from an outer circumferential surface of the base along the inside of the storage body, the door blade being configured to open or close the communication hole based upon an orientation the base and to agitate the food waste in the storage body; and a plurality of agitation blades that are spaced apart from the door blade by a predetermined distance, extend along the inside of the storage body, and are configured to agitate the food waste in the storage body based on rotation of the base. The door blade includes a scraper that is configured to scrape food waste from the storage body, and each agitation blade includes one or more bosses. The apparatus includes a housing door that is located on the housing body and configured to selectively open or close the outlet port; and a drawer that is configured to retract from the housing, the drawer defining a space that is configured to store the food waste discharged from the outlet port.

One object of the subject matter described in this application is to provide a food waste treatment apparatus which is capable of grinding, dehydrating and drying food waste and a discharge unit of the food waste treatment apparatus.

In addition, another object of the subject matter described in this application is to provide a food waste treatment apparatus which employs a dryer and a drying method for removing a great quantity of moisture contained in ground food waste and a discharge unit of the food waste treatment apparatus.

In addition, another object of the subject matter described in this application is to provide a food waste treatment apparatus which includes a rotating shaft intersecting a food introduction direction and a discharge unit of the food waste treatment apparatus.

In addition, a further object of the subject matter described in this application is to provide a food waste treatment apparatus which is capable of preventing air, discharged after drying food waste, from flowing backward, thereby preventing user discomfort and a discharge unit of the food waste treatment apparatus.

DETAILED DESCRIPTION

Figure 1:
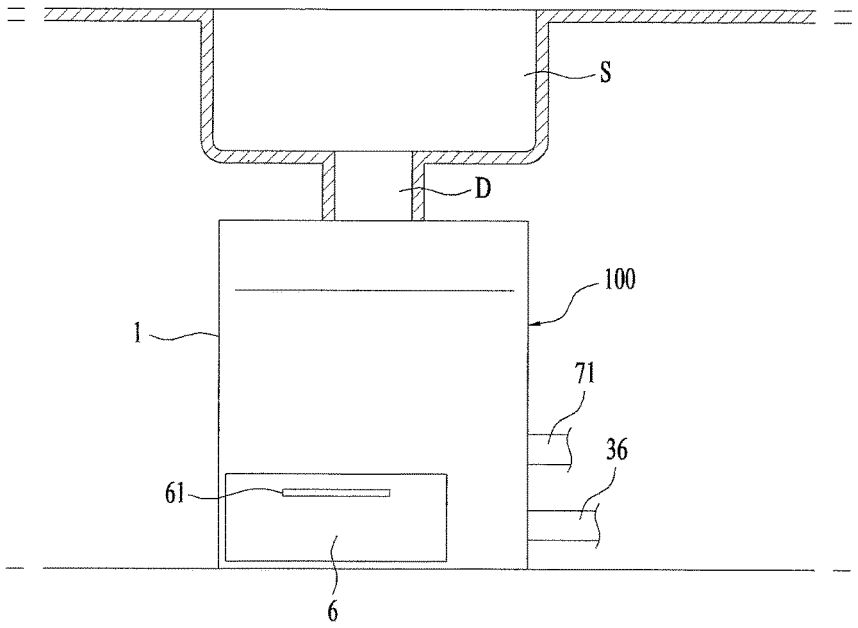
FIG. 1 is a schematic view of an example installation state of a food waste treatment apparatus.
Figure 2:
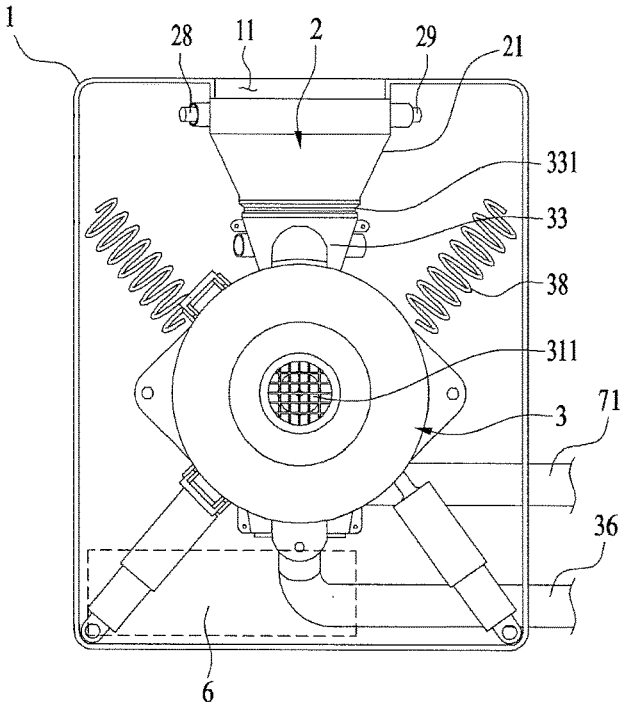
FIG. 2 is a front view of an example food waste treatment apparatus.
Figure 3:
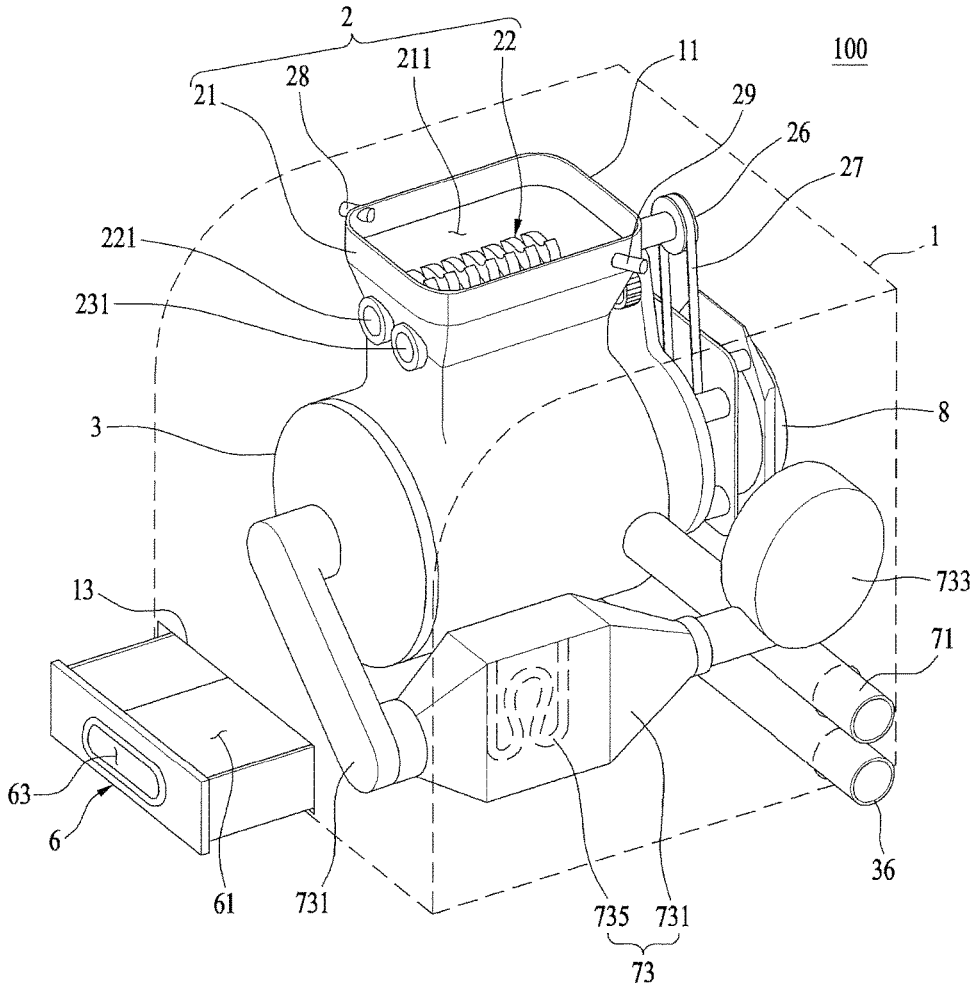
FIG. 3 is a perspective view of an example food waste treatment apparatus.

FIG. 1 illustrates an example installation state of a food waste treatment apparatus. FIG. 2 illustrates an example food waste treatment apparatus. FIG. 3 illustrates an example food waste treatment apparatus.

The food waste treatment apparatus 100*a* may be separably mounted to a drain D in a sink S. In some implementations, the food waste treatment apparatus 100*a* may be an independent apparatus that is separated from the sink S and configured to grind, dehydrate, and dry food waste introduced thereto by a user. For convenience of description, the following description is based on the food waste treatment apparatus 100*a* that is separably mounted to the sink S.

As illustrated in FIGS. 1 and 2, the food waste treatment apparatus 100*a* includes a cabinet 1 separably mounted to the drain D through a connection region 11, a grinder 2 installed in the cabinet 1 to grind food waste supplied from the drain D, a housing 3 into which the food waste, ground in the grinder 2, is introduced, and a dehydrator 4 rotatably installed in the housing 3 to provide a space for storage of the food waste and a space for treatment, for example, washing, grinding, dehydration, or drying, of the food waste.

Here, a drawer 6 may be installed in the cabinet 1 at a position below the housing 3 such that the food waste discharged from the housing 3 is stored in the drawer 6. The drawer 6, as illustrated in FIGS. 2 and 3, may include a drawer body 61 that is located below the housing 3 and provides a space in which the ground food waste is stored, and a handle 63 to assist the user in easily retracting the drawer body 61. In some implementations, the drawer body 61 may be retracted from the cabinet 1 through an opening 13 formed in the cabinet 1.

Meanwhile, the grinder 2 includes a support body 21 to guide the food waste, supplied from the connection region 11, to the housing 3, and first and second rotary cutters 22 and 23 arranged in the support body 21 to grind the food waste.

Figure 4:
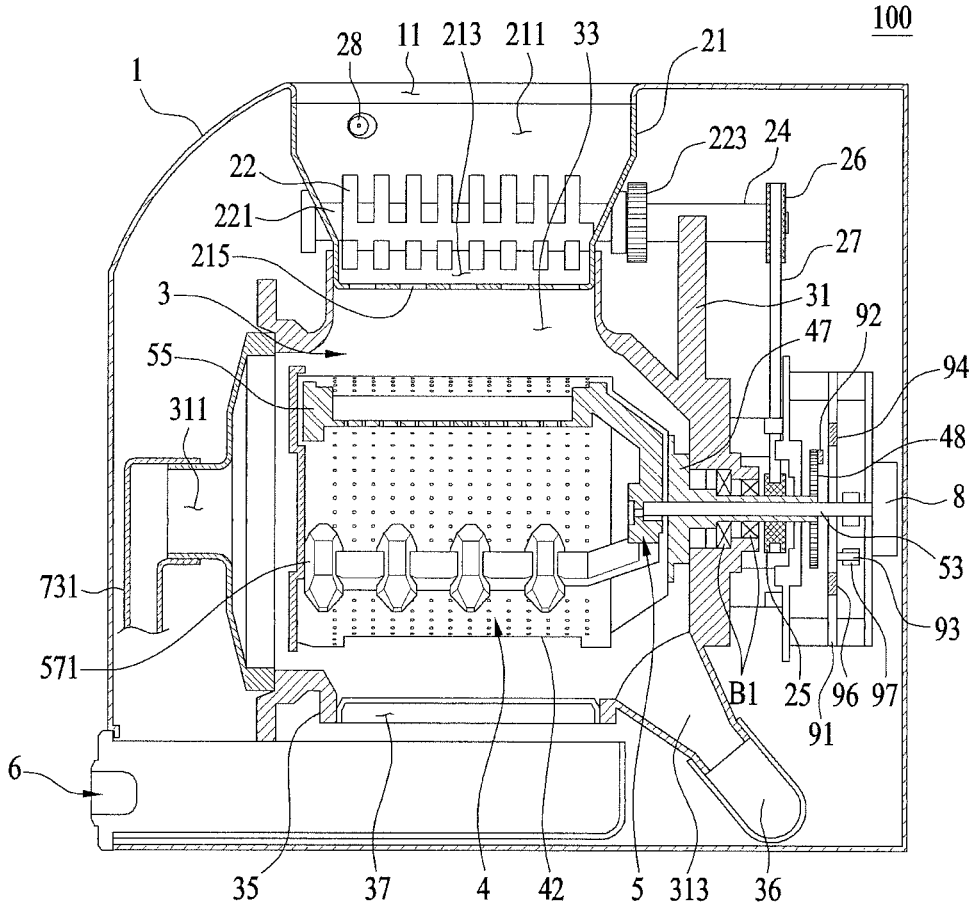
FIG. 4 is a sectional view of an example internal configuration of a food waste treatment apparatus.

As illustrated in FIG. 4, the support body 21 may take the form of a pipe, opposite sides of which are open. That is, the support body 21 may have an introduction side 211 that is in communication with the connection region 11 for supply of the food waste to the first and second rotary cutters 22 and 23 and a discharge side 213 for discharge of the food waste, ground by the first and second rotary cutters 22 and 23, to the housing 3.

The connection region 11 of the cabinet 1 and the introduction side 211 of the support body 21 may be shaped to assure coupling of the drain D in the sink S thereto.

The first and second rotary cutters 22 and 23 are located between the introduction side 211 and the discharge side 213 and adapted to be rotated in opposite directions.

Figure 6:
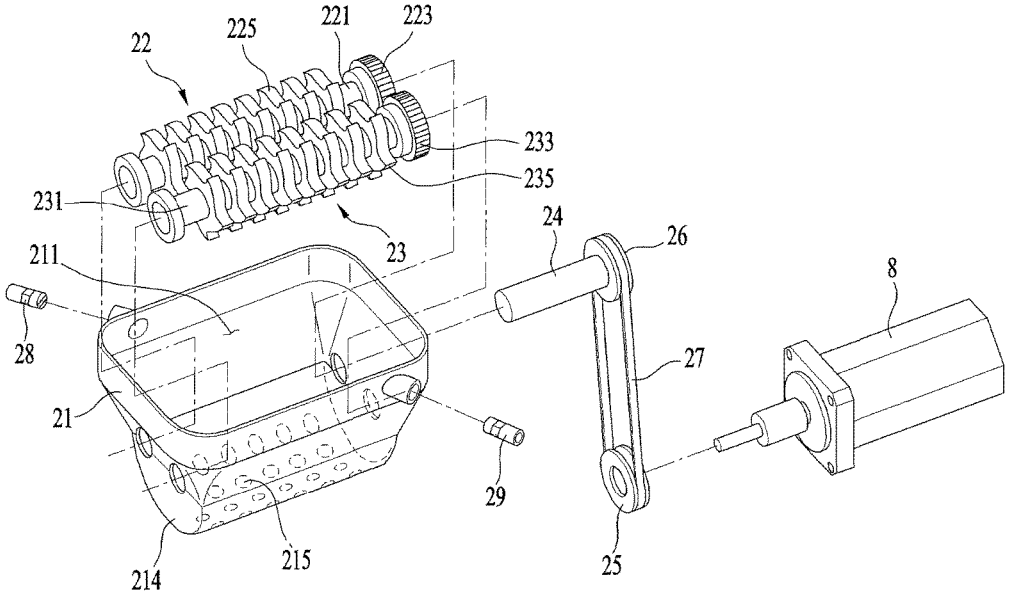
FIG. 6 is an exploded perspective view of an example grinder of a food waste treatment apparatus.

As illustrated in FIG. 6, the first rotary cutter 22 may include a first shaft 221 rotatably installed to the support body 21, a plurality of first cutters 225 coupled to the first shaft 221 so as to be located inside the support body 21, and a first gear 223 secured to the first shaft 221 so as to be located outside the support body 21.

The second rotary cutter 23 may include a second shaft 231 rotatably installed to the support body 21, a plurality of second cutters 235 coupled to the second shaft 231 so as to be located inside the support body 21, and a second gear 233 secured to the second shaft 231 so as to be connected to the first gear 223.

The first cutters 225 may be spaced apart from one another by a predetermined distance in the longitudinal direction of the first shaft 221, and the second cutters 235 may be located respectively in a space defined between a respective one of the first cutters 225 and a neighboring one of the first cutters 225.

The first and second rotary cutters 22 and 23 as described above may be rotated by a drive unit 8 that is used to rotate the dehydrator 4, or may be rotated by a drive unit that is provided separately from the drive unit 8.

In the case where the first and second rotary cutters 22 and 23 are rotated by the drive unit 8, a power transmission mechanism needs to be interposed between the grinder 2 and the drive unit 8. The power transmission mechanism may include a drive shaft 24 connected to the first gear 223, a driven pulley 26 coupled to the drive shaft 24, a driving pulley 25 configured to be rotated by the drive unit 8, and a belt 27 connecting the driving pulley 25 and the driven pulley 26 to each other.

When the drive unit 8 rotates the driving pulley 25, the first gear 223 is rotated by the belt 27 and the driven pulley 26. When the first gear 223 is rotated, the second gear 233 is rotated in an opposite direction of a rotation direction of the first gear 223. Thereby, the food waste, supplied through the introduction side 211, may be ground while passing between the first cutters 225 and the second cutters 235 and then moved to the discharge side 213.

Meanwhile, the food waste treatment apparatus 100*a* is capable of not only dehydrating the food waste using the dehydrator 4, but also drying the food waste using a dryer 73 that will be described below. The dehydration and drying efficiencies of the food waste may be enhanced by maintaining the particle size of food waste discharged from the grinder 2 at a given size or less.

To maintain the particle size of food waste discharged from the grinder 2 at a given size or less, the discharge side 213 of the support body 21 may be provided with a receiving portion 214 that defines a space in which the first and second rotary cutters 22 and 23 are received. A plurality of discharge holes 215 may be perforated in the receiving portion 214 such that the food waste is discharged from the receiving portion 214 through the discharge holes 215.

At least a portion of the circumference of each first cutter 225 and at least a portion of the circumference of each second cutter 235 are located in the space defined by the receiving portion 214. As such, the food waste, ground by the respective cutters 225 and 235 and introduced into the receiving portion 214, is subjected to grinding by the respective cutters 225 and 235 until it is ground to a sufficient size to pass through the discharge holes 215.

Meanwhile, in the case of food waste that is difficult to be ground or has high viscosity, the food waste ground by the cutters 225 and 235 may remain at cutter surfaces, rather than being separated from the cutters 225 and 235. In this case, foul odors due to decomposition of the food waste may be generated.

Figure 7:
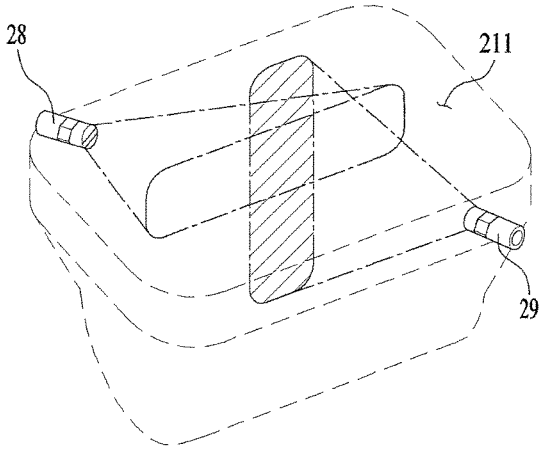
FIG. 7 is a schematic view of an example ejection of wash water in a food waste treatment apparatus.

To solve the problem as described above, the food waste treatment apparatus 100*a* may further include a wash water ejector to eject water into the support body 21. The wash water ejector may include a first nozzle 28 and a second nozzle 29 which are installed to the support body 21 to eject water supplied from the outside (see FIG. 7).

The first nozzle 28 may be shaped such that an ejection width in the direction parallel to the introduction side 211 is greater than an ejection width in the direction perpendicular to the introduction side 211. The second nozzle 29 may be shaped such that an ejection width in the direction perpendicular to the introduction side 211 is greater than an ejection width in the direction parallel to the introduction side 211. This serves to minimize an area of an inner space of the support body 21 where no water is supplied by differentiating supply areas of water ejected from the first nozzle 28 and the second nozzle 29.

To maximize this effect, the first nozzle 28 and the second nozzle 29 may be secured to the support body 21 so as to face each other and to eject water toward the first and second rotary cutters 22 and 23. In some implementations, an ejection angular range of water supplied from the first nozzle 28 and an ejection angular range of water supplied from the second nozzle 29 may be perpendicular to each other.

Figure 8C:
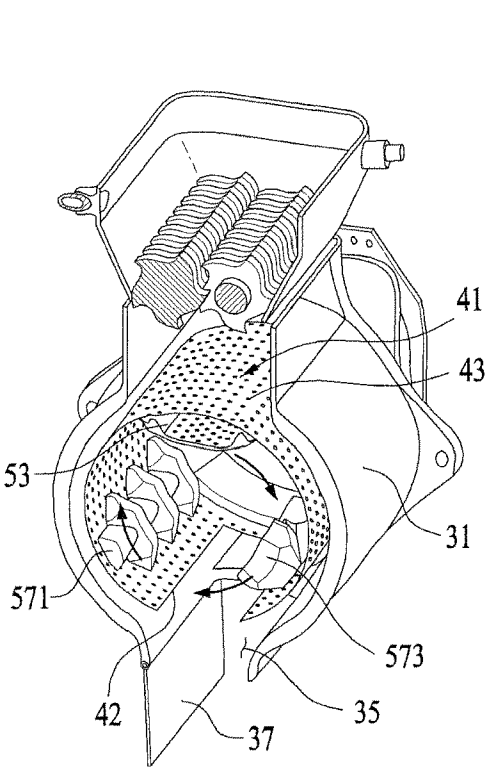
FIGS. 8(*a*), 8(*b*), and 8(*c*) are views of an example operating process of a dehydrator of a food waste treatment apparatus.
Figure 8B:
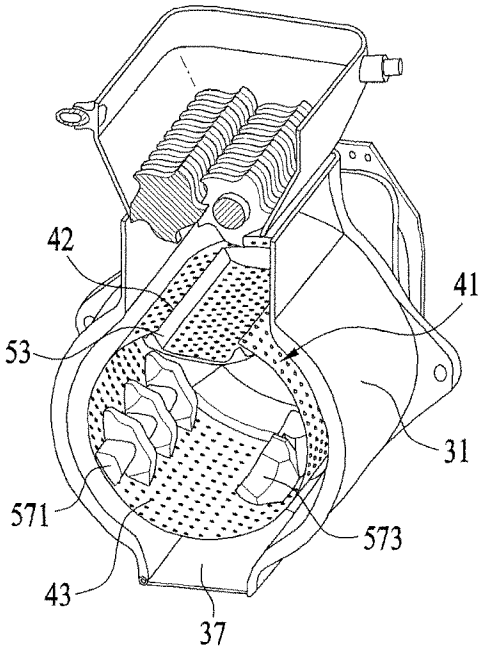
Figure 8A:
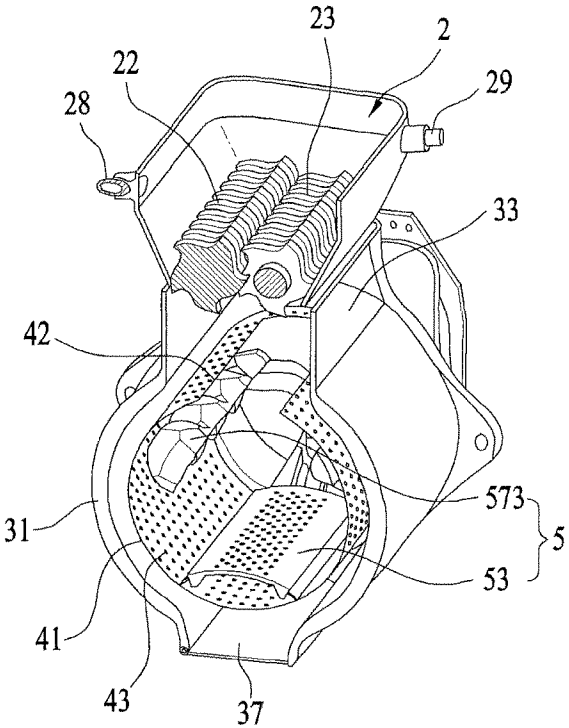

As illustrated in FIG. 8, the housing 3 may serve to connect the grinder 2 and the drawer 6 to each other, to provide a space in which the dehydrator 4 is received, and to guide water discharged from the drain D in the sink S to a sewage flow path.

The housing 3 includes a housing body 31 located between the grinder 2 and the drawer 6. The housing body 31 has an inlet port 33 that is in communication with the discharge side 213 or the discharge holes 215 of the grinder 2, and an outlet port 35 that is in communication with the drawer 6. That is, the housing 3 may take the form of a cylinder, opposite sides of which are open.

The housing 3 is connected to the support body 21 through a gasket (331, see FIG. 2), which prevents leakage of water between the support body 21 and the housing 3. Meanwhile, when the gasket 331 is formed of a vibration dampening material such as rubber, the gasket 331 may also serve to attenuate vibration between the support body 21 and the housing 3.

The outlet port 35 of the housing body 31 is opened or closed by a housing door 37 installed to the housing body 31. The housing door 37 is rotated by a housing door drive unit to selectively open the outlet port 35.

Meanwhile, the housing body 31 is supported by a vibration attenuator (38, see FIG. 2) within the cabinet 1. The vibration attenuator 38 serves to prevent vibration of the drive unit 8 located at the outer circumferential surface of the housing body 31 or vibration of the grinder 2 connected to the housing body 31 from being transmitted to the cabinet 1.

The vibration attenuator 38 may have any of various configurations so long as it can perform the above-described function. FIG. 2 illustrates the case where the vibration attenuator 38 includes a damper and a spring interposed between the cabinet 1 and the housing body 31 by way of example.

The housing body 31 is provided at the front side thereof with a first communication portion 311 for introduction of outside air during drying of the food waste. In addition, the housing body 31 is provided at the rear lower side thereof with a second communication portion 313 for drainage of water from the housing body 31. An exhaust duct 71 for exhaust of air from the inside of the housing body 31 is installed to a rear middle portion (e.g., at a position higher than the second communication portion 313) of the housing body 31. Here, a drain pipe 36 that defines the flow path of water drained from the second communication portion 313 is connected to the second communication portion 313.

Meanwhile, the exhaust duct 71 and the drain pipe 36 are connected to a discharge unit 100; 200; 300 that will be described hereinafter. Air directed to the exhaust duct 71 and water directed to the drain pipe 36 are exhausted and drained to a sewage flow path via the discharge unit 100; 200; 300.

Meanwhile, the discharge unit 100; 200; 300 (see FIGS. 15 to 20) is connected to the drain pipe 36 and the exhaust duct 71 arranged at one side of the food waste treatment apparatus 100*a* to discharge water drained from the food waste treatment apparatus 100*a* and dry air supplied during drying of the food waste through a sewage flow path. Here, the discharge unit 100; 200; 300 is configured to selectively discharge the water and air from the food waste treatment apparatus 100*a* through the sewage flow path. Various implementations of the discharge unit 100; 200; 300 are possible. The respective implementations of the discharge unit 100; 200; 300 will be described in detail after completion of description related to the food waste treatment apparatus 100*a*.

The dehydrator 4, installed inside the housing body 31, serves to dehydrate and agitate the food waste ground in the grinder 2 and then supplied to the housing 3. The dehydrator 4 includes a storage body 41 located inside the housing body 31 to provide a food waste storage space, a rotating shaft 47 oriented in parallel with the ground to rotatably support the storage body 41 inside the housing body 31, and a communication hole 42 perforated in the storage body 41, the communication hole 42 being in communication with the inlet port 33 or the outlet port 35 according to a rotation angle of the storage body 41.

The storage body 41 takes the form of an empty cylinder and the rotating shaft 47 is secured to the rear surface of the storage body 41.

Meanwhile, the circumferential surface, the front surface and the rear surface of the storage body 41 is formed with a plurality of through-holes 43 to communicate the inside of the storage body 41 with the inside of the housing body 31. As such, when the storage body 41 is rotated, water contained in the food waste may be discharged to the housing body 31 through the through-holes 43.

Figure 5:
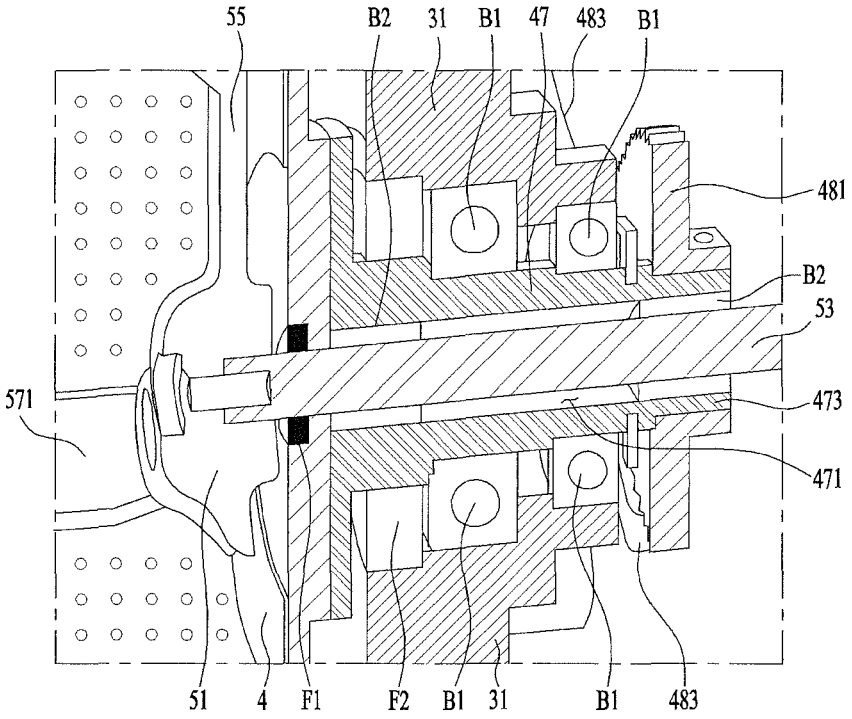
FIG. 5 is a sectional perspective view of an example shaft support portion of the food waste treatment apparatus.

As illustrated in FIGS. 4 and 5, the rotating shaft 47 serves to allow the storage body 41 to be rotatable about an axis that is in parallel with the ground. The rotating shaft 47 includes a shaft body 473 secured to the rear surface of the storage body 41 so as to penetrate the housing body 31 of the housing 3 and a shaft through-bore 471 formed through the shaft body 473 in the longitudinal direction of the shaft body 473.

The housing body 31 is provided with a bearing B1. The shaft body 473 is inserted into the bearing B1 so as to be rotatably coupled to the housing body 31. Meanwhile, a seal F2 is interposed between the housing body 31 and the shaft body 473 and serves to prevent water or food waste from entering a space between the housing body 31 and the shaft body 473.

The storage body 41 of the dehydrator 4 has a feature that it is rotated about an axis in parallel with the ground, rather than being rotated about an axis perpendicular to the ground.

In the case where the storage body 41 is rotated about the axis perpendicular to the ground, the user who attempts to discharge dehydrated food waste from the storage body 41 has to directly take the food waste out of the storage body 41 or to separate the storage body 41 from the food waste treatment apparatus 100*a*, which causes user inconvenience.

In some implementations, where the storage body 41 is rotated about the axis in parallel with the ground, the dehydrated food waste may be discharged from the storage body 41 via position control of the communication hole 42. Thus, it will be appreciated that rotation of the storage body 41 about the axis in parallel with the ground is more convenient than rotation of the storage body 41 about the axis perpendicular to the ground, as described in more detail below.

The food waste treatment apparatus 100*a* may further include an agitator 5 rotatably installed in the storage body 41, the agitator 5 serving to agitate the food waste inside the storage body 41 and to open or close the communication hole 42.

Figure 9:
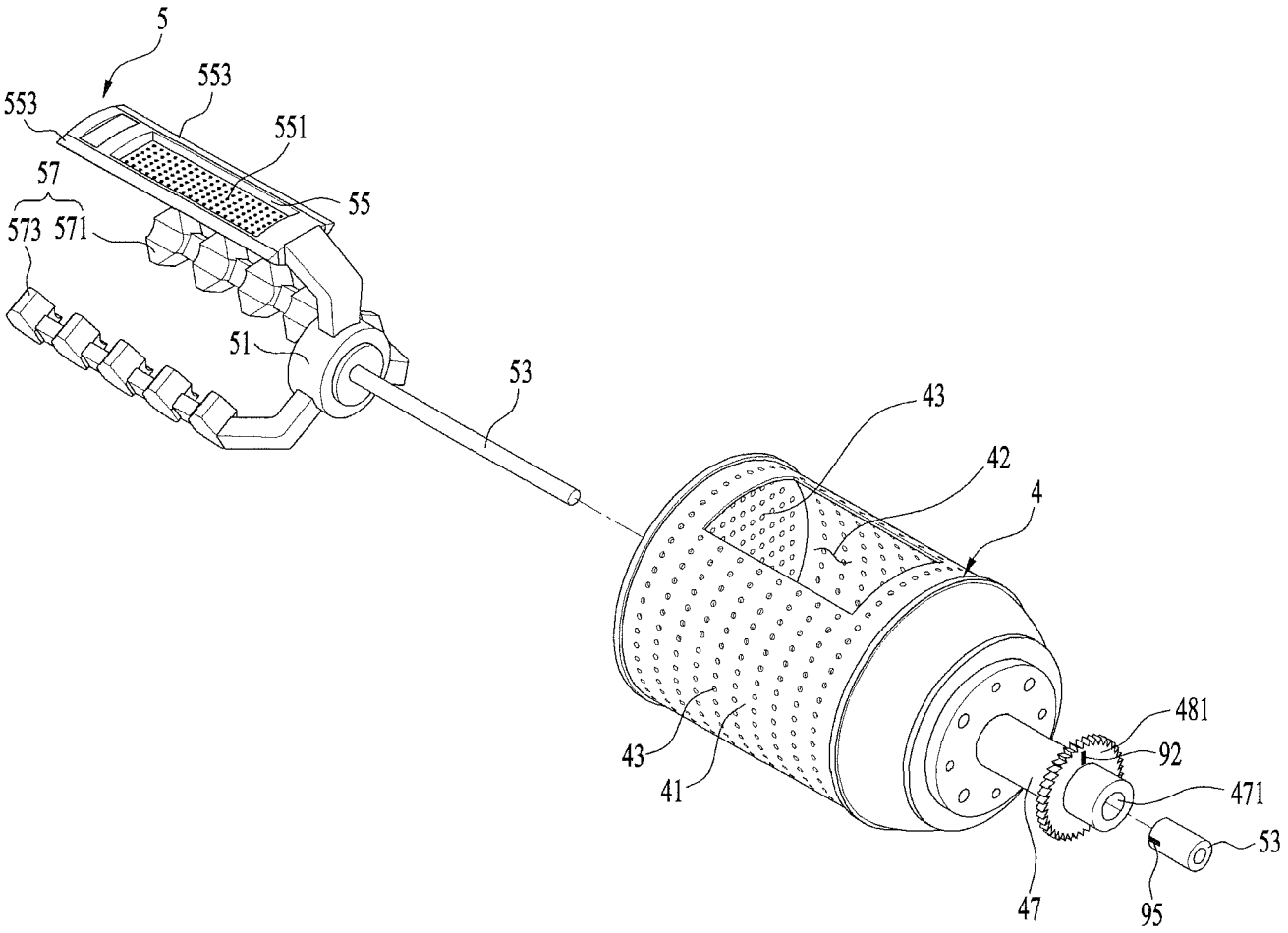
FIG. 9 is an exploded perspective view of an example dehydrator and agitator of a food waste treatment apparatus.

As illustrated in FIG. 9, the agitator 5 may include a base 51 located inside the storage body 41, a agitator rotating shaft 53 extending from the base 51 and inserted into the shaft through-bore 471, and a door blade 55 secured to the base 51 and located inside the storage body 41 to close the communication hole 42.

Meanwhile, as illustrated in FIGS. 4 and 5, the agitator rotating shaft 53 is inserted into the shaft through-bore 471 and serves to connect the base 51 and the drive unit 8 (e.g., a device that serves to rotate the agitator 5 and is located outside the housing 3) to each other.

A seal F1 is provided in the shaft through-bore 471 to prevent the food waste or water inside the dehydrator 4 from entering a space between the shaft through-bore 471 and the agitator rotating shaft 53. That is, the seal F1 is affixed to the rear surface of the storage body 41 formed with the shaft through-bore 471 to prevent the food waste or water from entering the shaft through-bore 471.

The agitator rotating shaft 53 is rotatably supported by a clutch B2 that is located inside the shaft through-bore 471. The clutch B2 may be a one-way clutch that transmits power, provided by the drive unit 8 only in one direction among the clockwise direction and the counterclockwise direction, to the shaft body 473.

Accordingly, when the drive unit 8 rotates the agitator rotating shaft 53 in a first direction, e.g., any one direction among the clockwise direction and the counterclockwise direction, the clutch B2 transmits rotational power provided by the agitator rotating shaft 53 to the shaft body 473, thus causing both the storage body 41 and the agitator 5 to be rotated together.

However, when the drive unit 8 rotates the agitator rotating shaft 53 in a second direction, e.g., the other direction among the clockwise direction and the counterclockwise direction, or an opposite direction of the first direction, the clutch B2 does not transmit rotational power provided by the agitator rotating shaft 53 to the shaft body 473, thus causing only the agitator 5 to be rotated without rotation of the storage body 41.

Despite the fact that the clutch B2 allows only the agitator 5 to be rotated without rotation of the storage body 41, the food waste treatment apparatus 100*a* may further include a lock 48 to prevent the storage body 41 from being rotated along with the agitator 5 when the agitator rotating shaft 53 is rotated in the second direction, e.g., to prevent the storage body 41 from being unintentionally rotated along with the agitator 5.

The lock 48 may include a first fastener 481 provided at the shaft body 473 and a second fastener 483 provided at the housing body 31 so as to be separably fastened to the first fastener 481.

Figure 10:
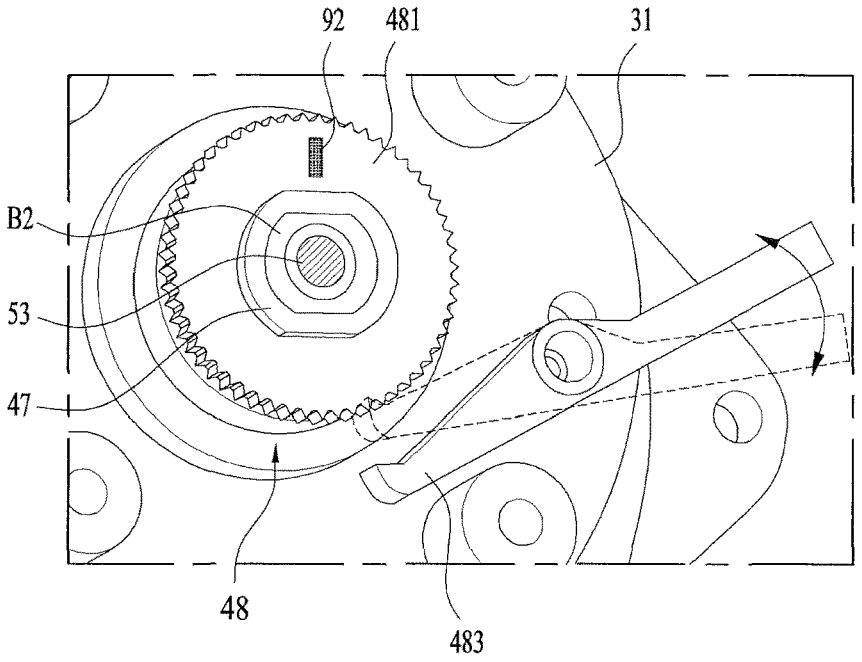
FIG. 10 is a partial perspective view of an example lock of a food waste treatment apparatus.

As illustrated in FIG. 10, the first fastener 481 may be a gear that is provided with teeth along the outer circumference thereof and secured to the shaft body 473. The second fastener 483 may be a bar that is rotatably coupled to the housing body 31 and has a free end to constrain rotation of the teeth of the first fastener 481.

The second fastener 483 is adapted to receive rotational power from a power supply device such as, for example, a motor or a solenoid. Thus, in the food waste treatment apparatus 100*a*, the agitator 5 and the storage body 41 may be rotated together when the drive unit 8 rotates the agitator 5 in the first direction, and only the agitator 5 may be rotated when the drive unit 8 rotates the agitator 5 in the second direction in a state in which the second fastener 483 and the first fastener 481 are engaged with each other.

Meanwhile, as illustrated in FIG. 9, the agitator 5 may further include an agitation blade 57 that is secured to the base 51 so as to be rotatable inside the storage body 41. The agitation blade 47 serves to enhance agitation efficiency of the food waste stored in the storage body 41.

The agitation blade 47 may include a first agitation blade 471 and a second agitation blade 573 which are spaced apart from the door blade 55 by the same angle on the basis of the agitator rotating shaft 53. That is, in the case where the agitation blade 57 includes the first agitation blade 571 and the second agitation blade 573, the door blade 55, the first agitation blade 571 and the second agitation blade 573 are spaced apart from one another by 120 degrees about the agitator rotating shaft 53.

To facilitate easy agitation of the food waste, the first agitation blade 571 and the second agitation blade 573 may be provided with a plurality of bosses.

The door blade 55 included in the agitator 5 may have a plurality of door through-holes 551 perforated in the door blade 55 to communicate the inside of the storage body 41 with the inside of the housing body 31.

Assuming that the door blade 55 has no door through-holes 551, water separated from the food waste during rotation of the storage body 41 cannot be discharged in the direction in which the door blade 55 is located, which may cause eccentric rotation of the storage body 41. The door through-holes 551 serve to prevent this problem.

In addition, the door through-holes 551 serve to enhance drying efficiency by allowing air supplied by the dryer 73 that will be described below to be supplied into the storage body 41.

Meanwhile, to facilitate easy agitation of the food waste by the door blade 55, the door blade 55 may be provided with scrapers 553.

Figure 11:
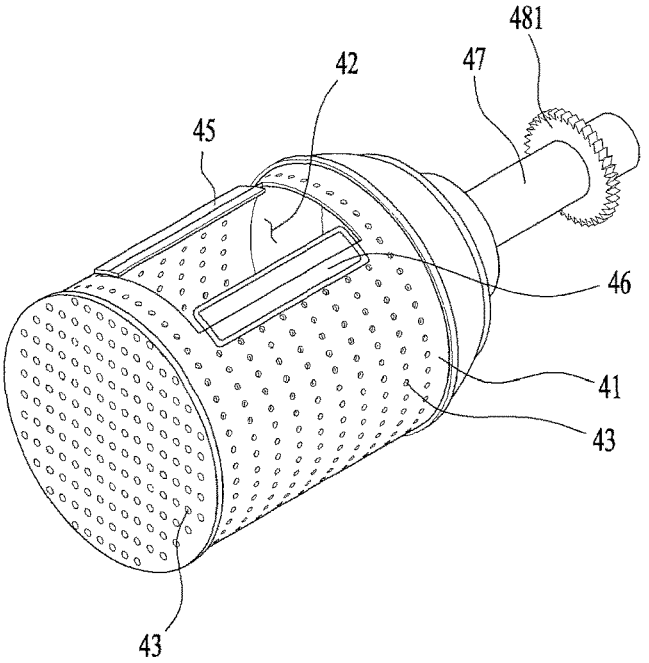
FIG. 11 is a perspective view of an example dehydrator and guide of a food waste treatment apparatus.
Figure 12:
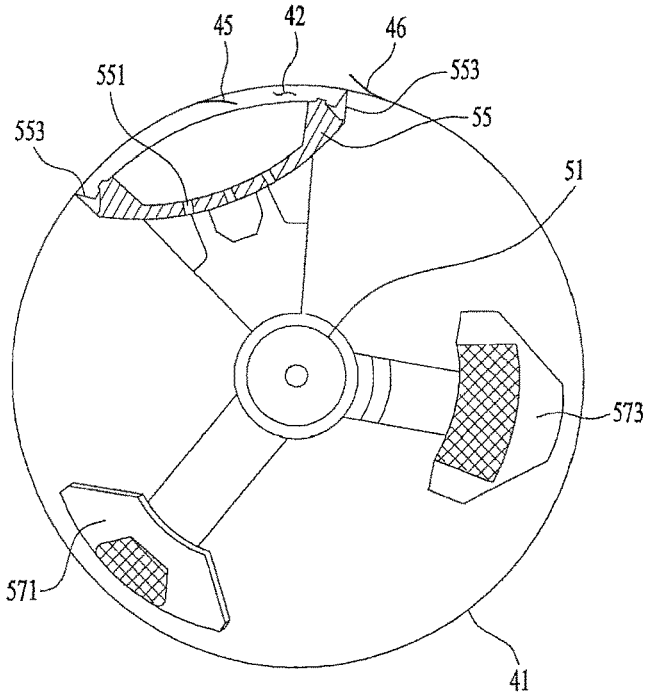
FIG. 12 is a sectional view of an example dehydrator and guide of a food waste treatment apparatus.

As illustrated in FIGS. 11 and 12, the scrapers 553 may protrude from the surface of the door blade 55 so as to come into contact with the surface of the storage body 41 and may be located respectively at both facing longitudinal ends of the door blade 55 that are in parallel with the rotation axis of the storage body 41. The scrapers 553 may be formed of an elastic material such as rubber.

When the door blade 55 provided with the scrapers 553 is rotated, the food waste stored inside the storage body 41 is easily agitated by the scrapers 553. However, the scarpers 553 may cause the food waste inside the storage body 41 to leak from the storage body 41 when the door blade 55 passes through the communication hole 42.

To solve this problem, the dehydrator 4 may further include a guide to prevent the food waste inside the storage body 41 from leaking from the storage body 41 through the communication hole 42.

The guide may include a first guide 45 protruding from the communication hole 42 toward the rotation center of the storage body 41, and a second guide 46 protruding from the communication hole 42 away from the rotation center of the storage body 41.

Accordingly, assuming that the second direction for rotation of the agitator 5 alone is set to the clockwise direction, upon rotation of the door blade 55, the first guide 45 may guide the food waste toward the storage body 41 and the second guide 46 may prevent separation of the food waste remaining on the scrapers 553.

The food waste treatment apparatus 100*a* having the above-described configuration may further include a first position sensing unit to sense a position of the communication hole 42 of the dehydrator 4 and a second position sensing unit to sense a position of the door blade 55.

Figure 13:
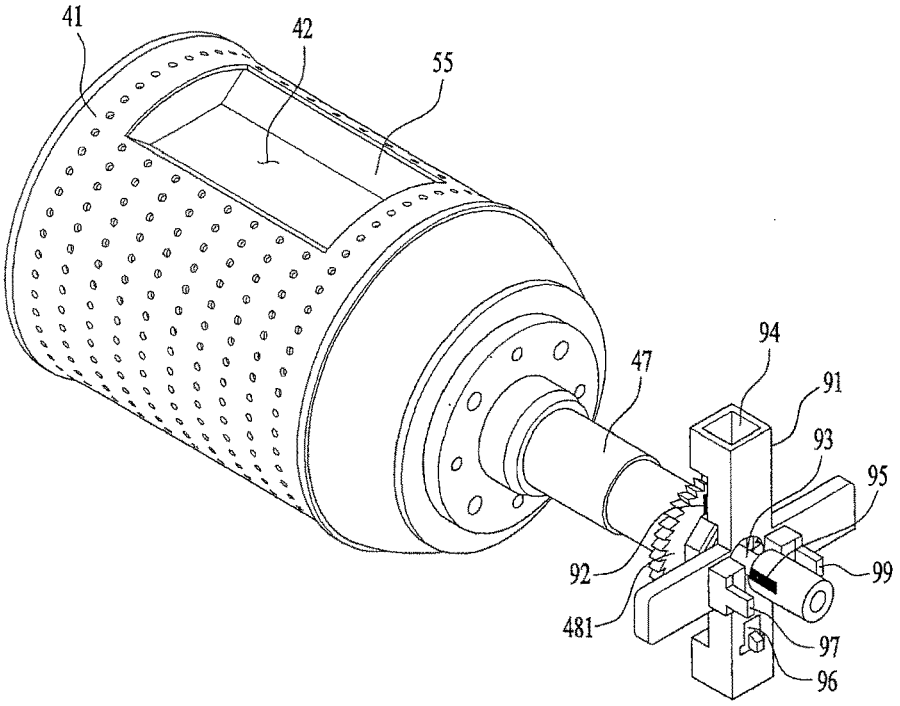
FIG. 13 is a perspective view of an example position sensing unit of a food waste treatment apparatus.

As illustrated in FIG. 13, the first position sensing unit may include a first magnetic substance 92 fixed to the rotating shaft 47 of the dehydrator 4, the first magnetic substance 92 being located next to the communication hole 42 in the longitudinal direction of the storage body 41, a first sensor 94 located at the housing body 31 at a position next to the inlet port 33 to sense the magnetic force of the first magnetic substance 92, and a second sensor 96 located at the housing body 31 at a position next to the outlet port 35 to sense the magnetic force of the first magnetic substance 92.

The first magnetic substance 92 may be attached to the first fastener 481 secured to the shaft body 473, and the first sensor 94 and the second sensor 96 may be attached to a first sensor support member 91 that is located outside the housing body 31.

In the case where the inlet port 33 and the outlet port 35 of the housing body 31 are located respectively at the top surface and the bottom surface of the housing body 31 (spaced apart from each other by 180 degrees on the basis of the shaft body 473), the first sensor 94 and the second sensor 96 need to be spaced apart from each other by 180 degrees.

Meanwhile, the second position sensing unit may include a second magnetic substance 95 fixed to the agitator rotating shaft 53, and a third sensor 97 located outside the housing body 31, the third sensor 97 judging whether or not the door blade 55 closes the communication hole 42 by sensing the magnetic force of the second magnetic substance 95.

The second magnetic substance 95 may be spaced apart from the door blade 55 by a predetermined angle about the agitator rotating shaft 53 and may be located next to the door blade 55 in the longitudinal direction of the agitator rotating shaft 53.

Meanwhile, as illustrated in FIG. 13, there is illustrated, by way of example, the case where the second magnetic substance 95 is spaced apart from the door blade 55 by 90 degrees about the agitator rotating shaft 53 and the third sensor 97 is fixed to a second support member 93 that is located outside the housing body 31, the third sensor 97 being spaced apart from the first sensor 94 by 90 degrees.

Meanwhile, the food waste treatment apparatus 100*a* may further include the dryer 73 to dry the food waste stored in the dehydrator 4 by supplying air to the housing 3.

As illustrated in FIG. 3, the dryer 73 may include a supply duct 731 to guide air to the housing body 31, a fan 733 to supply air to the supply duct 731, a heater 755 to heat air introduced into the supply duct 731, and the exhaust duct 71 to communicate the inside of the housing body 31 with the outside of the cabinet 1.

The supply duct 731 may be connected to the first communication portion 311 of the housing body 31, and the exhaust duct 71 may be in communication with the rear middle region of the housing body 31 and connected to a plughole located outside the cabinet 1.

As such, when the fan 733 is operated, air inside the cabinet 1 is moved to the housing body 31 through the supply duct 731 and heated by the heater 735.

The air introduced into the housing body 31 is supplied to the inside of the storage body 41 through the through-holes 43 formed, for example, in the circumferential surface and the front surface of the storage body 41. Then, the air heat exchanged with the food waste is discharged from the cabinet 1 through the exhaust duct 71.

Hereinafter, operation of the food waste treatment apparatus 100*a* will be described in detail. The respective components mentioned below should be understood with reference to the above description and the accompanying drawings.

An operation process of the food waste treatment apparatus 100*a* will be described below in detail with reference to FIG. 14.

Figure 14:
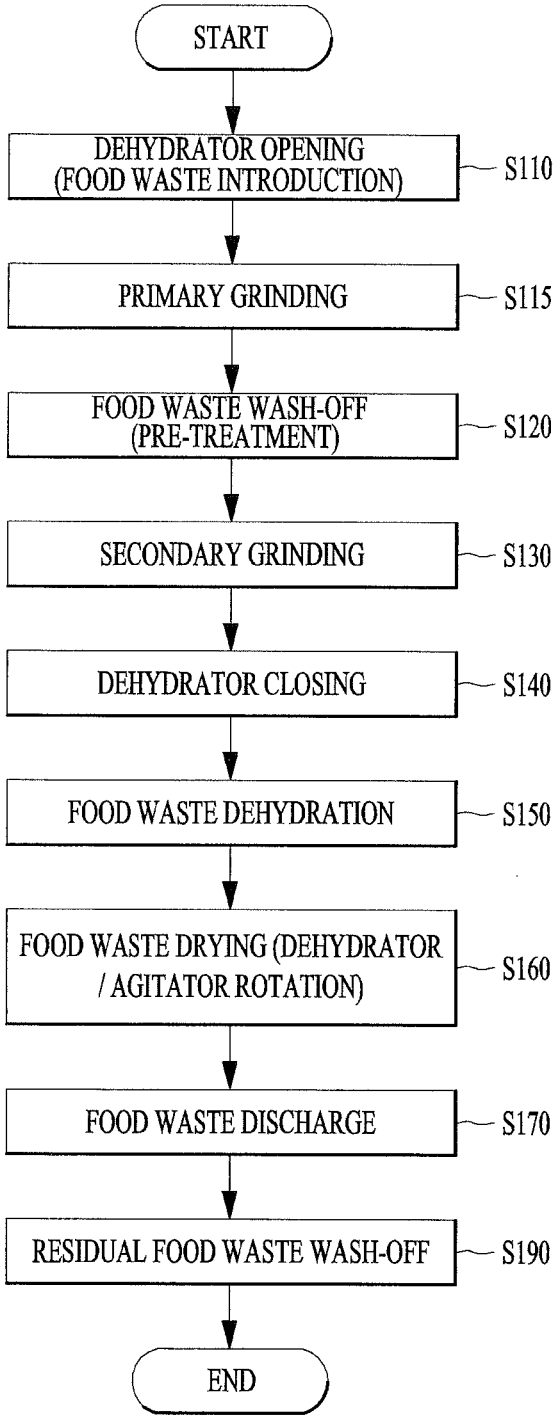
FIG. 14 is a flowchart of an example control method of a food waste treatment apparatus.

FIG. 14 illustrates an example control method of a food waste treatment apparatus.

First, a controller performs a dehydrator opening step S110 of communicating the dehydrator 4 and the housing 3 with each other to enable introduction of food waste. When the food waste is introduced by the user as the dehydrator opening step S110 is completed, the controller proceeds to a primary grinding step S115 of primarily grinding the introduced food waste and guiding the ground food waste to the dehydrator 4. Then, the controller performs a food waste wash-off step S120 of removing, for example, highly viscous grounds or fine powder included in the food waste, primarily ground and introduced into the dehydrator 4. Once the food waste has been washed off in the food waste wash-off step S120, the controller proceeds to a secondary grinding step S130 of grinding the food waste inside the dehydrator 4. After completion of the secondary grinding step S130, the controller proceeds to a closing step S140 of closing the communication hole 42 of the dehydrator 4. Then, the closing step S140 is followed by a food waste dehydration step S150 of removing moisture contained in the ground food waste. Then, the controller proceeds to a food waste drying step S160 and a food waste discharge step S170 in sequence. Finally, once the dried food waste has been discharged, the controller proceeds to a residual food waste wash-off step S190 of washing the housing 3 and the dehydrator 4 having undergone the washing, grinding, and drying of the food waste.

Meanwhile, among the steps as described above, the food waste wash-off step S120 of removing highly viscous grounds or fine powder included in the food waste from the food waste and the residual food waste wash-off step S190 of washing off food waste residues inside the food waste treatment apparatus 100*a*, which has performed the washing, grinding and drying of the food waste, after completion of all of the aforementioned steps may be selectively performed according to user selection, and may be omitted as needed.

The dehydrator opening step S110 includes communicating the communication hole 42 with the inlet port 33 of the housing 3 by rotating the dehydrator 4 and opening the communication hole 42 by the door blade 55 via rotation of the agitator 5 alone. Here, whether or not the communication hole 42 reaches a position for communication with the inlet port 33 is judged based on whether or not the first sensor 94 senses the magnetic force of the first magnetic substance 92.

That is, since the first magnetic substance 92 is fixed to the rotating shaft 47 of the dehydrator 4 so as to be located next to the communication hole 42 and the first sensor 94 is attached to the housing 3 so as to be located next to the inlet port 33, a controller, e.g., a device to control operation of the drive unit 8, change in the rotation direction of the drive unit 8, operation of the dryer 73 and the dehydrator 4, and operation of the wash water ejector, may determine that the communication hole 42 is located below the inlet port 33 when the first sensor 94 senses the magnetic force of the first magnetic substance 92.

Upon judging that the communication hole 42 is located below the inlet port 33, the controller stops operation of the drive unit 8 to stop rotation of the dehydrator 4 and the agitator 5.

In some implementations, the controller may change the rotation direction of the drive unit 8 to allow the agitator 5 to be rotated in the second direction, e.g., so that the dehydrator 4 stops and only the agitator 5 is rotated, thereby causing the door blade 55 to open the communication hole 42.

That is, since the second magnetic substance 95 and the third sensor 97 are provided respectively at the agitator rotating shaft 53 and the housing 3 so as to face each other when the door blade 55 closes the communication hole 42, the controller may determine that the door blade 55 closes the communication hole 42 when the third sensor 97 senses the magnetic force of the second magnetic substance 95 and may also determine that the door blade 55 opens the communication hole 42 when the third sensor 97 cannot sense the magnetic force of the second magnetic substance 95.

Accordingly, upon judging that the third sensor 97 senses the second magnetic substance 95, the controller rotates only the agitator 5 until the third sensor 97 cannot sense the second magnetic substance 95, thereby opening the communication hole 42 of the dehydrator 4. In this case, a positional relationship between the housing 3, the dehydrator 4, and the agitator 5 is as illustrated in FIG. 8(*a*).

Subsequently, the grinding step S115 of primarily grinding the introduced food waste is performed. The grinding step S115 is a step in which the controller rotates the first rotary cutter 22 and the second rotary cutter 23 via the drive unit 8 or a separate drive unit. The grinding step S115 may further include ejecting water via the wash water ejector 28 and 29 during rotation of the first rotary cutter 22 and the second rotary cutter 23. This serves to prevent the food waste from remaining on the first and second rotary cutters 22 and 23.

Meanwhile, upon completion of the primary grinding step S115, the controller may perform the food waste wash-off step S120 of washing off the food waste received in the dehydrator 4. Here, the food waste wash-off step S120 serves to remove highly viscous food waste grounds or fine food waste powder, which may hinder implementation of the grinding step S130, included in the food waste received in the dehydrator 4.

The food waste wash-off step S120 includes a wash water supply process of washing off highly viscous grounds and fine powder included in the food waste, a food waste rinsing process of removing the highly viscous grounds and fine powder included in the food waste using the supplied wash water, and a wash water drainage process of draining the wash water used to wash off the food waste.

First, prior to supplying wash water to the housing body 31, the housing door 37 provided at the bottom of the housing body 31 is closed. Here, in a state in which the housing door 37 has already been closed, a process of closing the housing door 37 may be omitted.

Subsequently, wash water for rinsing off the food waste is supplied to the housing body 31. The supply of wash water may be performed via the first nozzle 28 and the second nozzle 29 of the wash water ejector included in the grinder 2, and may be directly performed within the housing body 31 via a separate water supply aperture.

Meanwhile, upon completion of the supply of wash water, a process of rinsing off the food waste stored in the dehydrator 4 is performed. Here, the process of rinsing off the food waste may selectively include rotating the agitator 5 alone and rotating the agitator 5 and the dehydrator 4 simultaneously.

First, the case where the dehydrator 4 remains stationary and only the agitator 5 is rotated in the food waste rinsing process will be described below.

The controller maintains communication between the communication hole 42 of the dehydrator 4 and the inlet port 3 of the housing body 31 as in the above-described dehydrator opening step S110 and rotates the agitator 5 at predetermined RPM for a predetermined time to mix the food waste stored in the dehydrator 4 with wash water. Thereby, as the food waste received in the dehydrator 4 is mixed with the wash water stored in the housing body 31, highly viscous grounds and fine powder included in the food waste are diluted or separated.

Next, the case where the agitator 5 and the dehydrator 4 are rotated simultaneously in the food waste rinsing process will be described.

To rotate the agitator 5 and the dehydrator 4 simultaneously, first, it is necessary to close the communication hole 42 formed in the dehydrator 4. That is, when the agitator 5 and the dehydrator 4 are rotated in a state in which the communication hole 42 of the dehydrator 5 is not closed, the food waste introduced into the dehydrator 4 may leak from between the dehydrator 4 and the housing body 31. Therefore, the communication hole 42 of the dehydrator 4 needs to be closed using the door blade 55 of the agitator 5 before the dehydrator 4 and the agitator 5 are rotated simultaneously.

Here, closing of the communication hole 42 of the dehydrator 4 is performed based on judgment of whether or not the third sensor 97 senses the magnetic force of the second magnetic substance 95. Since that the third sensor 97 cannot sense the magnetic force of the second magnetic substance 95 means that the communication hole 42 of the dehydrator 4 is opened, the controller rotates the drive unit 8 in the second direction, e.g., so as to rotate only the agitator 5, until the third sensor 97 senses the magnetic force of the second magnetic substance 95. A positional relationship between the housing 3, the dehydrator 4, and the agitator 5 in a closed state of the communication hole 42 of the dehydrator 4 is as illustrated in FIG. 8(*b*).

Subsequently, the dehydrator 4 and the agitator 5 remain in a state in which the door blade 55 of the agitator 5 closes the communication hole 42 of the dehydrator 4. The agitator 5 and the dehydrator 4 are rotated at predetermined RPM for a predetermined time to mix the food stored in the dehydrator 4 with wash water. Thereby, as the food waste received in the dehydrator 4 is mixed with the wash water stored in the housing body 31, highly viscous grounds and fine powder included in the food waste are diluted or separated.

Meanwhile, once impurities such as, for example, the highly viscous grounds and fine powder have been separated from the food waste via rotation of the dehydrator 4 and/or the agitator 5, the wash water mixed with the impurities such as, for example, the highly viscous grounds and fine powder is drained. Here, drainage of the wash water may be performed by opening the exhaust duct 71 provided at the housing body 31.

Subsequently, the food waste wash-off step S120 of the dehydrator 4 is completed, and the controller performs the secondary grinding step S130 of secondarily grinding the food waste stored in the dehydrator 4. Here, the secondary grinding step S130 is a process of mixing and grinding the food waste stored in the dehydrator 4 by rotating only the agitator 5 in a state in which rotation of the dehydrator 4 stops. Here, through rotation of the agitator 5, the food waste stored in the dehydrator 4 is agitated within the dehydrator 4 by the door blade 55 and the agitation blade 57 of the agitator 5 and, simultaneously, ground by friction with the inner surface of the dehydrator 4. However, only the primary grinding step S110 using the grinder 2 may be performed and the secondary grinding step S130 may be omitted according to the amount and kind of the food waste.

Subsequently, upon completion of the food waste wash-off step S120 or the secondary grinding step S130, the dehydrator closing step S140 of closing the dehydrator 4 for dehydration of the food waste is performed. The food waste treatment apparatus 100*a* is adapted to perform dehydration of the food waste by simultaneously rotating the agitator 5 and the dehydrator 4.

Accordingly, when the agitator 5 and the dehydrator 4 are rotated in a state in which the communication hole 42 of the dehydrator 4 is not closed, the food waste introduced into the dehydrator 4 may leak from between the dehydrator 4 and the housing body 31. Accordingly, it is necessary to close the communication hole 42 of the dehydrator 4 using the door blade 55 of the agitator 5 prior to simultaneously rotating the dehydrator 4 and the agitator 5.

Meanwhile, the controller judges whether or not the grinder 2 is operated and stands by the operation stop of the grinder 2 upon judging that operation of the grinder 2 does not stop. Here, upon checking the operation stop of the grinder 2, the controller begins sensing of the third sensor 97.

Here, closing of the communication hole 42 of the dehydrator 4 is performed based on judgment of whether or not the third sensor 97 senses the magnetic force of the second magnetic substance 95. Since that the third sensor 97 cannot sense the magnetic force of the second magnetic substance 95 means that the communication hole 42 of the dehydrator 4 is opened, the controller rotates the drive unit 8 in the second direction, e.g., so as to rotate only the agitator 5, until the third sensor 97 senses the magnetic force of the second magnetic substance 95. A positional relationship of the housing 3, the dehydrator 4, and the agitator 5 in a closed state of the communication hole 42 of the dehydrator 4 is as illustrated in FIG. 8(*b*).

Subsequently, the controller performs the dehydration step S150 of dehydrating the food waste stored in the dehydrator 4 upon completion of the dehydrator closing step S140.

The dehydration step S150 is a step of discharging the water contained in the food waste from the storage body 41 of the dehydrator 4 into the housing body 31 by simultaneously rotating the dehydrator 4 and the agitator 5 at a predetermined first RPM, e.g., so as to rotate the agitator rotating shaft 53 in the first direction.

Here, the storage body 41 of the dehydrator 4 may fail to maintain dynamic equilibrium, or dynamic balance, according to a position of the food waste stored therein, thereby being rotated. Dynamic equilibrium means a state in which centrifugal force or moment created by the centrifugal force becomes zero with respect to a rotating shaft during rotation of a rotator. In the case of a rigid body, the rigid body maintains dynamic equilibrium when mass distribution is constant about a rotating shaft.

Dynamic equilibrium in the food waste treatment apparatus 100*a* may be understood as the case where mass distribution of the food waste about the rotating shaft 47 of the storage body 41 is within an allowable range during rotation of the storage body 41 in which the food waste is received, e.g., the case where the storage body 41 is rotated while vibrating within an allowable range.

In some implementations, an unbalanced state in the food waste treatment apparatus 100*a* occurs in the case where mass distribution of the food waste about the rotating shaft 47 is not uniform, e.g., not within an allowable range, during rotation of the storage body 41, e.g., the case where the food waste is not uniformly distributed within the storage body 41.

At this time, when the storage body 41 is rotated in an unbalanced state, this may cause deterioration in dehydration efficiency and generation of vibration and noise of the storage body 41 and the housing body 31. Therefore, it is necessary to remove such unbalance prior to beginning the dehydration step S150.

For unbalance removal, unbalance of the storage body 41 of the dehydrator 4 is sensed and whether the sensed unbalance is a reference UB, or reference value, or less is judged.

Here, unbalance sensing is sensing an RPM variation of the storage body 41 after rotating the agitator 5 and the storage body 41 at a second RPM that is lower than the first RPM so as to keep the communication hole 42 closed. In addition, judgment of the unbalanced state of the storage body 41 is based on sensing whether or not the storage body 41 is in the unbalanced state by comparing the measured RPM variation with the reference value.

The RPM variation of the storage body 41 and the agitator 5 may be measured using various methods. For example, a Hall sensor may be used to sense the magnetic force of a magnetic substance provided at a rotor of the drive unit 8.

In some implementations, the controller may determine the RPM variation by subtracting the minimum RPM from the maximum RPM of the storage body 41 based on a signal transmitted from the Hall sensor after rotating the storage body 41 and the agitator 5 at the second RPM for a given time.

Meanwhile, when the measured RPM variation is a predetermined reference value or less, the controller judges that the food waste stored in the storage body 41 is not in an eccentric state relative to the rotating shaft 47. However, when the measured RPM variation is greater than the predetermined reference value, the controller judges that the food waste is in an eccentric state relative to the rotating shaft 47.

When the food waste stored in the storage body 41 is not in an eccentric state relative to the rotating shaft 47, the controller directly performs the dehydration step S150. However, when the food waste stored in the storage body 41 is in an eccentric state relative to the rotating shaft 47, the controller supplies water to the housing body 31 and rotates the agitator 5 so as to remove unbalance of the storage body 41.

More specifically, the controller may remove unbalance by rotating only the agitator 5 without rotating the storage body 41 so as to rearrange the food waste within the storage body 41 during rotation of the agitator 5.

Meanwhile, when attempting to rotate only the agitator 5, this needs to be performed after a position of the dehydrator 4 is controlled so that the communication hole 42 of the storage body 41 is located to be in communication with the inlet port 33 of the housing body 31, in order to prevent the food waste within the storage body 41 from being discharged to the housing body 31. Thus, when attempting to rotate only the agitator 5, a process of controlling a position of the communication hole 42 may be performed and a process of controlling a position of the door blade 55 to close the communication hole 42 when rotation of the agitator 5 stops may be performed.

In addition, the supply of water for unbalance removal may be performed via the wash water ejector 28 and 29 included in the grinder 2 and may be performed via a separate supply pipe that connects the housing body 31 and an external water supply source to each other.

Water supplied to the housing body 31 via the water supply process may be introduced into the storage body 41 through the through-holes 43 of the storage body 41. Therefore, the water supplied to the housing body 31 causes the food waste to be rearranged within the storage body 41, which enables removal of the unbalanced state.

Although the unbalance sensing process as described above has been described based on the case where a UB sensing process of sensing whether or not the storage body 41 is in the unbalanced state is performed, the sensing process included in the control method may further include a load sensing process of determining the amount of the food waste stored in the storage body 41 in addition to the above-described unbalance sensing process.

Here, determining the amount of the food waste stored in the storage body 41 serves to reduce a dehydration time by increasing the first RPM, which is set for the dehydration step S150, so as to be proportional to the amount of the food waste.

In addition, when the amount of the food waste is determined, the dehydration time set for the dehydration step S150 may be increased in proportion to the amount of the food waste, which may result in complete dehydration of the food waste.

In addition, when the amount of the food waste is determined, the output, e.g., heat emission, of the heater 735 may be increased in proportion to the amount of the food waste in the drying step S160 that will be described below, or an implementation time, e.g., drying time, of the drying step S160 may be increased in proportion to the amount of the food waste, which may result in reduced drying time and complete drying of the food waste.

Then, the process of determining the amount of the food waste may be performed by measuring a time from a point in time when supply of power to the drive unit 8, which rotates the dehydrator 4 and the agitator 5 at the second RPM for unbalance sensing stops to a point in time when rotation of the dehydrator 4 and the agitator 5 stops.

The amount of the food waste stored in the storage body 41 of the dehydrator 4 is proportional to a time required to stop rotation of the storage body 41 and the agitator 5 that are being rotated at the second RPM.

Accordingly, when the controller compares a time required to stop rotation of the storage body 41 that is being rotated at the second RPM after stopping the supply of power to the drive unit 8 with time data required to stop rotation of the storage body 41 that is being rotated at the second RPM according to the amount of food waste, the controller may determine the amount of the food waste stored in the storage body 41.

Meanwhile, when it is desired to perform both the food waste unbalance sensing process and the food waste amount sensing process, the food waste unbalance sensing process is followed by the food waste amount sensing process. Subsequently, at least one of a water supply process and an agitation process may be performed according to the sensed results of the unbalanced state and amount of the food waste.

Meanwhile, upon judging that unbalance of the storage body 41 of the dehydrator 4 is removed, the control method proceeds to the dehydration step S150 of rotating both the storage body 41 and the agitator 5 together so that the communication hole 42 of the storage body 41 remains closed by the door blade 55 of the agitator 5.

Meanwhile, revolutions per minute, or a first RPM, and a reference dehydration time of the storage body 41, which are set for the dehydration step S150, may be set to fixed values regardless of the amount of the food waste stored in the storage body 41, or may be set to be increased in proportion to the amount of the food waste measured in the second sensing step as described above.

In some implementations, the controller may set dehydration time data corresponding to the amount of the food waste currently stored in the storage body 41, among a plurality of pieces of dehydration time data that may be stored in the controller or a separate storage medium and sorted according to the amount of food waste, to the reference dehydration time.

When the rotation time, or dehydration time, of the storage body 41 and the agitator 5 reaches the reference dehydration time, the control method proceeds to the drying step S160 of drying the food waste within the storage body 41.

The drying step S160 may include a drying process of drying the food waste and a determination process of determining a drying time of the food waste.

Here, the drying step S160 may include only a process of supplying hot air into the housing body 31 via the dryer 73, or may further include a process of rotating only the agitator 5 that is simultaneously performed with the process of supplying hot air.

In the case where the drying step S160 includes the process of rotating the agitator 5, the control method may proceed to the drying step S160 after performing a process of controlling a position of the dehydrator 4 so that the communication hole 42 of the storage body 41 communicates with the inlet port 33 of the housing body 31.

This serves to prevent the food waste stored in the storage body 41 from leaking to the housing body 31 when the agitator 5 is rotated during implementation of the drying step S160. That is, upon implementation of the drying step 160 in which the agitator 5 is rotated, a process of controlling a position of the communication hole 42, a process of rotating only the agitator 5, and a process of controlling a position of the door blade 55 so as to close the communication hole 42 by the door blade 55 when rotation of the agitator 5 stops may be performed.

Meanwhile, the drying step S160 may be continuously performed while hot air is supplied to the housing body 31, e.g., for a reference drying time, and may be repeated plural times within the reference drying time.

The reference drying time, which is set for the drying step S160, may be preset to a fixed value regardless of the amount of the food waste, or may be set to be increased in proportion to the amount of the food waste measured in the above-described food waste amount sensing process.

In some implementations, the controller may set drying time data corresponding to the amount of the food waste currently stored in the storage body 41, among a plurality of pieces of drying time data that may be stored in the controller or a separate storage medium and sorted according to the amount of food waste, to the reference drying time.

The above-described drying step S160 ends when a time for which hot air is supplied to the food waste, e.g., drying time, reaches the reference drying time. When the drying step S160 ends, the control method proceeds to the food waste discharge step S170 of discharging the food waste stored in the storage body 41 to the drawer 6.

The food waste discharge step S170 may include a communication process of communicating the communication hole 42 with the outlet port 35 of the housing 3 by rotating the dehydrator 4, an outlet port opening process of opening the outlet port 35 by controlling the housing door 37, and a discharge process of discharging the food waste from the storage body 41 by rotating only the agitator 5.

The communication process of communicating the communication hole 42 with the outlet port 35 of the housing 3 by rotating the dehydrator 4 includes causing the agitator 5 and the dehydrator 4 to be rotated together as the drive unit 8 rotates the agitator rotating shaft 53 in the first direction and stopping the rotation of the dehydrator 4 and the agitator 5 when the communication hole 42 of the dehydrator 4 reaches a position coinciding with the outlet port 35 of the housing 3. Here, judgment of whether or not the communication hole 42 reaches the position for communication with the outlet port 35 is performed based on whether or not the second sensor 96 senses the magnetic force of the first magnetic substance 92. That is, since the first magnetic substance 92 is fixed to the rotating shaft 47 of the dehydrator 4 so as to be located next to the communication hole 42 and the second sensor 96 is attached to the housing 3 so as to be located next to the outlet port 35, the controller may check that the communication hole 42 is located above the outlet port 35 when the second sensor 96 senses the magnetic force of the first magnetic substance 92. Here, upon judging that the communication hole 42 is located above the outlet port 35, the controller stops operation of the drive unit 8 to stop rotation of the dehydrator 4 and the agitator 5.

Meanwhile, when the communication process of communicating the communication hole 42 with the outlet port 35 of the housing 3 by rotating the dehydrator 4 is completed, an outlet port opening process of opening the outlet port 35 of the housing 3 by the housing door 37 is performed.

When the outlet port opening process of opening the outlet port 35 of the housing 3 by the housing door 37 is completed, the controller performs a discharge process of rotating only the agitator 5 for a given time by changing the rotation direction of the drive unit 8 to the second direction.

When the discharge process is performed for a predetermined time, the food waste inside the storage body 41 is discharged to the drawer 6 through the communication hole 42 and the outlet port 35 via rotation of the agitator 5. At this time, a positional relationship of the housing 3, the dehydrator 4 and the agitator 5 is as illustrated in FIG. 8(*c*). The control method may end simultaneously with completion of the discharge process.

In some implementations, the control method may further include a step of closing the communication hole 42 by the door blade 55 or closing the outlet port 35 by the housing door 37 after completion of the discharge process.

In the case where the second position sensing unit includes only the second magnetic substance 95 and the third sensor 97, the communication hole closing step may include a process of rotating the dehydrator 4 and the agitator 5 together until the first sensor 94 senses the magnetic force of the first magnetic substance 92, e.g., until the communication hole 42 reaches a position for communication with the inlet port 33, and a process of rotating only the agitator 5 until the third sensor 97 senses the magnetic force of the second magnetic substance 95.

However, in the case where the second position sensing unit a further includes a fourth sensor (99, see FIG. 13) that is fixed to the housing body 31 and spaced apart from the third sensor 97 by 180 degrees, the communication hole closing step may include a process of rotating only the agitator 5 until the fourth sensor 99 senses the magnetic force of the second magnetic substance 95.

Since the second magnetic substance 95 and the third sensor 97 are located at positions where whether or not the door blade 55 has closed the communication hole 42 may be judged, in a state in which the fourth sensor 99 is spaced apart from the third sensor 97 by 180 degrees, the door 44 may be located above the outlet port 35 when the fourth sensor 99 senses the magnetic force of the second magnetic substance 95.

Accordingly, the communication hole 42, which is located to be in communication with the outlet port 35 after completion of the discharge step S170, is closed by the door blade 55 when the fourth sensor 99 senses the magnetic force of the second magnetic substance 95.

Meanwhile, closing the outlet port 35 serves to allow water introduced into the housing 3 through the drain D in the sink S to move to the exhaust duct 71 through the second communication portion 313 other than the drawer 6.

The process of closing the outlet port 35 may be performed simultaneously with or before the process of closing the communication hole 42 by the door blade 55.

Subsequently, upon judging that the discharge of the food waste is completed, the residual food waste wash-off step S190 of washing off the residual food waste remaining in the housing body 31 of the housing 3, the storage body 41 of the dehydrator 4, and the door blade 55 and the agitation blade 57 of the agitator 5 is performed.

The residual food waste wash-off step S190 includes closing the housing door 37 provided at the bottom of the housing body 31 prior to supplying wash water to the housing body 31. Here, in a state in which the housing door 37 has already been closed, the process of closing the housing door 37 may be omitted.

Subsequently, wash water for rinsing off the food waste is supplied to the housing body 31. The supply of wash water may be performed via the first nozzle 28 and the second nozzle 29 of the wash water ejector included in the grinder 2, or may be directly performed within the housing body 31 by a separate water supply aperture.

Meanwhile, upon completion of the supply of wash water, a wash-off process of washing off the residual food waste remaining on the housing body 31, the dehydrator 4, and the agitator 5 is performed. Here, the wash-off process may selectively include a process of rotating the agitator 5 and a process of simultaneously rotating the agitator 5 and the dehydrator 4.

First, in the case where the dehydrator 4 remains stationary and only the agitator 5 is rotated in the wash-off process, the agitator 5 is rotated at predetermined RPM for a predetermined time to separate food waste residues attached to the respective blades 55 and 57 of the agitator 5 and food waste residues remaining on the inner wall of the dehydrator 4.

Hereinafter, in the case where the agitator 5 and the dehydrator 4 are rotated simultaneously in the wash-off process, the dehydrator 4 and the agitator 5 are rotated at predetermined RPM for a predetermined time to separate food waste residues attached to the inner wall of the housing body 31 and the inner wall of the dehydrator 4.

The rotation of the agitator 4 as well as the rotation of both the agitator 5 and the dehydrator 4 in the wash-off process as described above may be selectively performed according to user setting, or may be alternately performed at a predetermined interval.

Thereafter, upon completion of washing of the housing body 31, the dehydrator 4 and the agitator 5, the controller performs a wash water drainage process of discharging the wash water. Here, prior to performing the wash water drainage process, it is necessary to perform a process of aligning the communication hole 42 of the dehydrator 4 with the bottom of the housing body 31.

To align the communication hole 42 of the dehydrator 4 so as to face the bottom of the housing body 31, first, the controller first rotates the dehydrator 4 and judges whether or not the communication hole 42 faces the bottom of the housing body 31 based on whether or not the second sensor 96 senses the magnetic force of the first magnetic substance 92. Subsequently, the controller opens the drain valve 36*a* to drain the wash water stored in the housing body 31. Thereby, the wash water used to wash the food waste residues in the housing body 31, the dehydrator 4 and the agitator 5 is discharged to the drain pipe 36 of the housing body 31 through the communication hole 42 of the dehydrator 4.

Meanwhile, in the above-described food waste treatment apparatus 100*a*, water is drained during the washing and dehydration of the food waste and the washing of the food waste treatment apparatus 100*a* and air for drying of food the waste is exhausted during drying of the food waste.

In the above-described processes, the discharged air and the exhausted air are normally discharged through plumbing. However, when water generated from the food waste and air used to dry the food waste are discharged to the plumbing, some of the air exhausted to the plumbing may flow backward to the food waste treatment apparatus 100*a* to thereby leak to a room.

In this case, foul odors of the food waste or the plumbing are introduced into the room, causing user discomfort. For this reason, there is a demand for a discharge unit capable of efficiently discharging the water and air generated in the food waste treatment apparatus 100*a* to the plumbing.

Hereinafter, the discharge unit 100; 200; 300 will be described in detail with reference to the accompanying drawings. Various implementations of the discharge unit 100; 200; 300 will be shown and the common components will be described using the same names and the same reference numerals.

Figure 15:
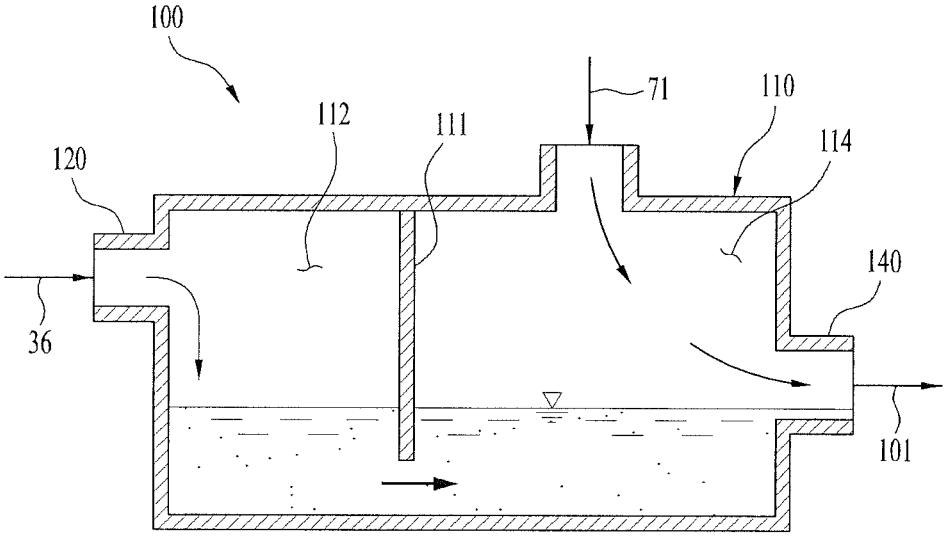
FIGS. 15 and 16 are schematic views illustrating an example discharge unit in a food waste treatment apparatus.
Figure 16:
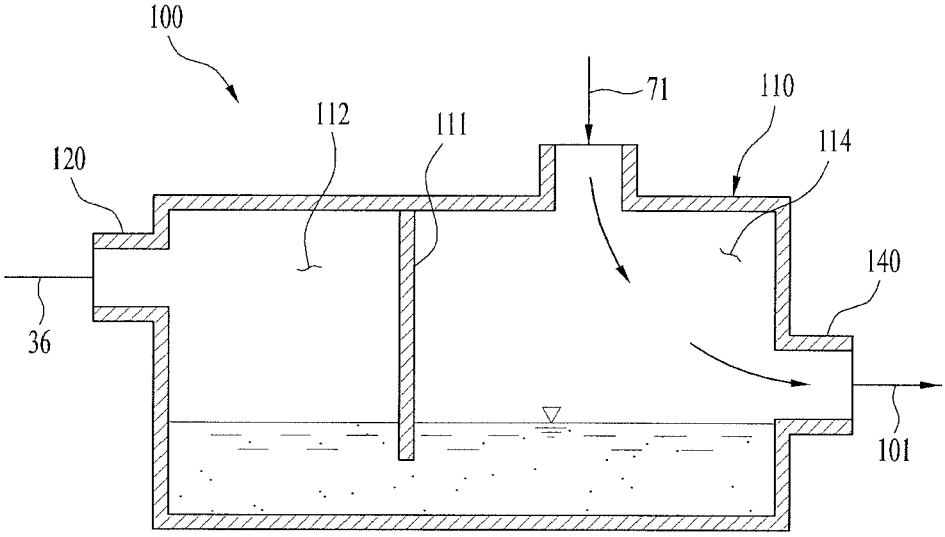

FIGS. 15 and 16 illustrate examples of the discharge unit included in a food waste treatment apparatus.

As illustrated in FIG. 15, the discharge unit 100 defines discharge paths for water that is generated during dehydration after grinding of food waste in the food waste treatment apparatus 100*a*, wash water used during wash-off of the food waste (hereinafter referred to as "water") and air supplied during drying of the food waste.

First, the discharge unit 100 includes a discharge body 110 internally defining a space for temporary storage and passage of water and air. A partition 111 is installed inside the discharge body 110 to divide the inner space of the discharge body 110 into a first space 112 and a second space 114 which are in communication with each other. Here, the lower end of the partition 111 and the inner bottom space of the discharge body 110 are spaced apart from each other by a predetermined distance to allow the water staying in the first space 112 to move to the second space 114.

Meanwhile, a water inlet port 120 for introduction of water discharged from the food waste treatment apparatus 100*a* is located at one side of the first space 112 and an air inlet port 130 for introduction of air discharged from the food waste treatment apparatus 100*a* is located at the top of the second space 114.

Here, the drain pipe 36 connected to the housing body 31 of the food waste treatment apparatus 100*a* is connected to the water inlet port 120, and the exhaust duct 71 connected to the housing body 31 of the food waste treatment apparatus 100*a* is connected to the air inlet port 130.

In addition, the second space 114 is provided at the other side thereof with an outlet port 140, through which the water, introduced into the first space 112 and having passed below the lower end of the partition 111, is discharged to a sewage flow path and, simultaneously, air introduced from the top of the second space 114 is discharged to the sewage flow path. Plumbing 101 is installed to the outlet port 140 so as to extend to the sewage flow path.

Meanwhile, the bottom surface of the discharge body 110 and the lower end of the partition 111 are spaced apart from each other by a predetermined distance. This provides a space for movement of the water from the first space 112 to the second space 114. The lower end of the partition 111 continuously remains submerged in the water staying in the first space 112 and the second space 114. This serves to prevent the air introduced through the air inlet port 130 of the second space 114 from flowing backward to the first space 112.

Accordingly, the water inlet port 120 of the first space 112, the outlet port 140 of the second space 114, and the lower end of the partition 111 need to have different heights. That is, the height of the outlet port 140 may be lower than the height of the water inlet port 120. The height of the lower end of the partition 111 may be between the height of the water inlet port 120 and the height of the outlet port 140.

Hereinafter, operation of the discharge unit 100 will be described.

First, the case where water and air are discharged simultaneously from the food waste treatment apparatus 100*a* will be described with reference to FIG. 15.

As illustrated in FIG. 15, in the case where water is discharged through the drain pipe 36 of the food waste treatment apparatus 100*a* according to operation of the food waste treatment apparatus 100*a*, the discharged water is introduced into the water inlet port 120 through the drain pipe 36 and supplied to the first space 112 of the discharge body 110 of the discharge unit 100. The water supplied to the first space 112 moves to the second space 114 through the space below the partition 111 that separates the first space 112 and the second space 114 from each other, thus causing the level of water to gradually rise from the bottom of the first and second spaces 112 and 114. As such, when the level of water reaches the height of the outlet port 140 of the second space 114, the water introduced into the water inlet port 120 of the first space 112 is discharged to the sewage flow path through the outlet port 140 of the second space 114.

Here, air discharged from the food waste treatment apparatus 100*a* is introduced into the air inlet port 130 formed at the top of the second space 114 of the discharge body 110 of the discharge unit 110. The introduced air temporarily stays in the second space 114 and then discharged to the sewage flow path through the outlet port 140 of the second space 114.

Meanwhile, the case where only air is discharged from the food waste treatment apparatus 100*a* will be described below with reference to FIG. 16.

As illustrated in FIG. 16, during the drying step of the food waste treatment apparatus 100*a* or when the food waste treatment apparatus 100*a* is not operated, a predetermined amount of water remains in an accumulated state in the first and second spaces 112 and 114 of the discharge unit 100. At this time, the amount of water accumulated in the first and second spaces 112 and 114 is kept at the height of the outlet port 140 of the second space 114. As the level of water is kept at the height of the outlet port 140, the lower end of the partition 111 remains submerged in the water. Thus, the first space 112 and the second space 114 remain separated from each other by the partition 111.

In some implementations, when air is supplied to the air inlet port 130 of the second space 114, the introduced air is directed to the outlet port 140 of the second space 114 after passing through the second space 114, thereby being exhausted to the sewage flow path through the outlet port 140.

Meanwhile, in the food waste treatment apparatus 100*a*, the exhaust duct 71 for air movement includes no component to control the flow of air moving through the exhaust duct 71.

Accordingly, in the case of air moving to the discharge unit 100 through the exhaust duct 71, the air may flow backward to the exhaust duct 71 according to a discharge state of the discharge unit 100, thereby flowing backward to the food waste treatment apparatus 100*a*.

To prevent the backflow of air from the exhaust duct 71 as described above, when using the discharge unit 100, the fan 733 of the dryer 73 may be continuously operated to assure the flow of air from the food waste treatment apparatus 100*a* to the discharge unit 100.

Figure 17:
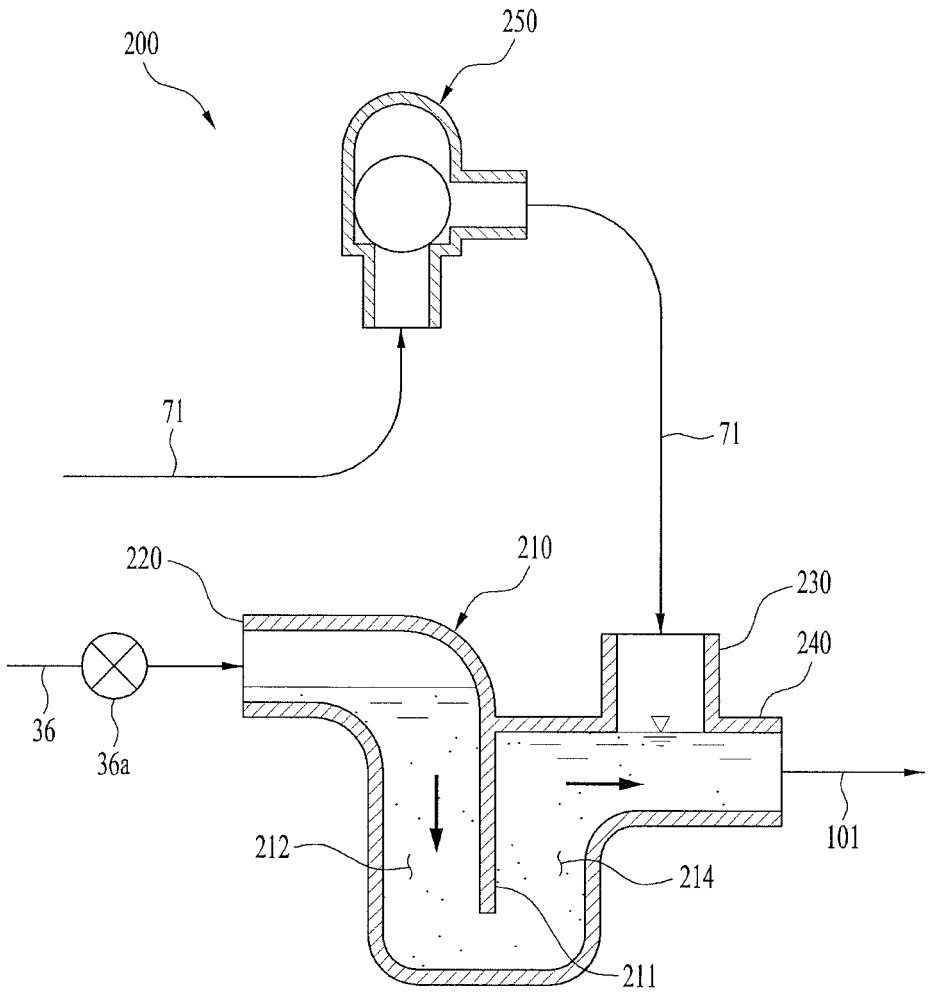
FIGS. 17 and 18 are schematic views of example discharge units in a food waste treatment apparatus.
Figure 18:
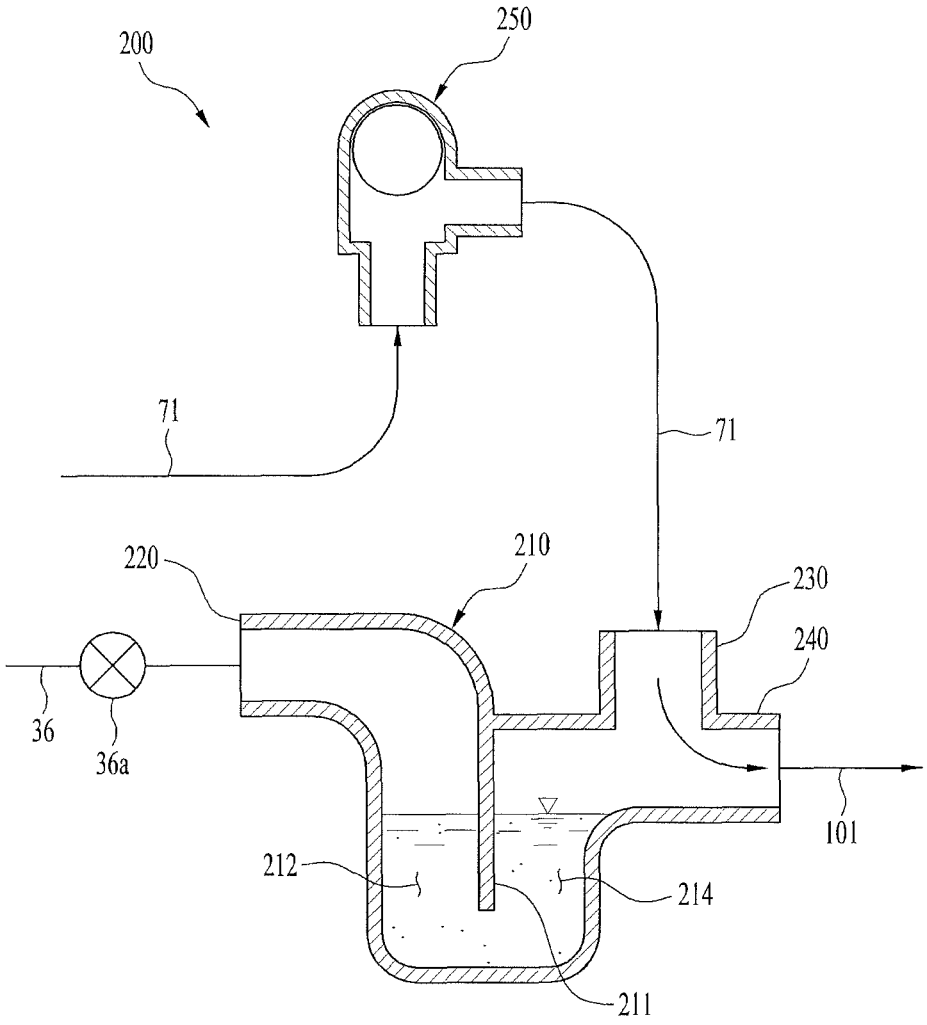

In some implementations, as illustrated in FIGS. 17 and 18, the exhaust duct 71 connected to the discharge unit 200 may be provided with a check valve 250 to prevent the backflow of air, in order to prevent the backflow of air from the discharge unit 200 to the food waste treatment apparatus 100*a*.

FIGS. 17 and 18 illustrate examples of a discharge unit of a food waste treatment apparatus.

As illustrated in FIG. 17, the discharge unit 200 includes a discharge body 210 internally defining a space for temporary storage and passage of water and air. A partition 211 is installed inside the discharge body 210 to divide the inner space of the discharge body 210 into a first space 212 and a second space 214 which are in communication with each other. Here, the lower end of the partition 211 and the inner bottom space of the discharge body 210 are spaced apart from each other by a predetermined distance to allow the water staying in the first space 212 to move to the second space 214.

Meanwhile, a water inlet port 220 for introduction of water discharged from the food waste treatment apparatus 100*a* is located at one side of the first space 212 and an air inlet port 230 for introduction of air discharged from the food waste treatment apparatus 100*a* is located at the top of the second space 214.

Here, the drain pipe 36 connected to the housing body 31 of the food waste treatment apparatus 100*a* is connected to the water inlet port 220, and the exhaust duct 71 connected to the housing body 31 of the food waste treatment apparatus 100*a* is connected to the air inlet port 130.

Meanwhile, the exhaust duct 71 is provided with the check valve 250 to limit the movement direction of air through the exhaust duct 71.

In addition, the second space 214 is provided at the other side thereof with an outlet port 240, through which the water, introduced into the first space 212 and having passed below the lower end of the partition 211, is discharged to a sewage flow path and, simultaneously, air introduced from the top of the second space 214 is discharged to the sewage flow path. The plumbing 101 is installed to the outlet port 240 so as to extend to the sewage flow path.

Meanwhile, the bottom surface of the discharge body 210 and the lower end of the partition 211 are spaced apart from each other by a predetermined distance. This provides a space for movement of the water from the first space 212 to the second space 214. The lower end of the partition 211 continuously remains submerged in the water staying in the first space 212 and the second space 214. This serves to prevent the air introduced through the air inlet port 230 of the second space 214 from flowing backward to the first space 212.

Accordingly, the water inlet port 220 of the first space 212, the outlet port 240 of the second space 214, and the lower end of the partition 211 need to have different heights. That is, the height of the outlet port 240 may be lower than the height of the water inlet port 220. The height of the lower end of the partition 211 may be between the height of the water inlet port 220 and the height of the outlet port 240.

Hereinafter, operation of the discharge unit 200 will be described.

First, the case where water and air are discharged simultaneously from the food waste treatment apparatus 100*a* will be described with reference to FIG. 17.

As illustrated in FIG. 17, in the case where water is discharged through the drain pipe 36 of the food waste treatment apparatus 100*a* according to operation of the food waste treatment apparatus 100*a*, the discharged water is introduced into the water inlet port 220 through the drain pipe 36 and supplied to the first space 212 of the discharge body 210 of the discharge unit 200. The water supplied to the first space 212 moves to the second space 214 through the space below the partition 211 that separates the first space 212 and the second space 214 from each other, thus causing the level of water to gradually rise from the bottom of the first and second spaces 212 and 214. As such, when the level of water reaches the height of the outlet port 240 of the second space 214, the water introduced into the water inlet port 220 of the first space 212 is discharged to the sewage flow path through the outlet port 240 of the second space 214.

Here, air discharged from the food waste treatment apparatus 100*a* is introduced into the air inlet port 230 formed at the top of the second space 214 of the discharge body 210 of the discharge unit 210. The introduced air temporarily stays in the second space 214 and then discharged to the sewage flow path through the outlet port 240 of the second space 214.

Meanwhile, the case where only air is discharged from the food waste treatment apparatus 100*a* will be described below with reference to FIG. 18.

As illustrated in FIG. 18, during the drying step of the food waste treatment apparatus 100*a* or when the food waste treatment apparatus 100*a* is not operated, a predetermined amount of water remains in an accumulated state in the first and second spaces 212 and 214 of the discharge unit 200. At this time, the amount of water accumulated in the first and second spaces 212 and 214 is kept at the height of the outlet port 240 of the second space 214. As the level of water is kept at the height of the outlet port 240, the lower end of the partition 211 remains submerged in the water. Thus, the first space 212 and the second space 214 remain separated from each other by the partition 211.

In some implementations, when air is supplied to the air inlet port 230 of the second space 214, the introduced air is directed to the outlet port 240 of the second space 214 after passing through the second space 214, thereby being exhausted to the sewage flow path through the outlet port 240.

At this time, the check valve 250 installed to the exhaust duct 71 is opened by the pressure of air passing through the exhaust duct 71, causing a path from the food waste treatment apparatus 100*a* to the discharge unit 200 to be opened. However, when movement of air from the discharge unit 200 to the food waste treatment apparatus 100*a* occurs, the check valve 250 closes the path of the exhaust duct 71 by the pressure of air, thereby preventing the backflow of air.

Figure 19:
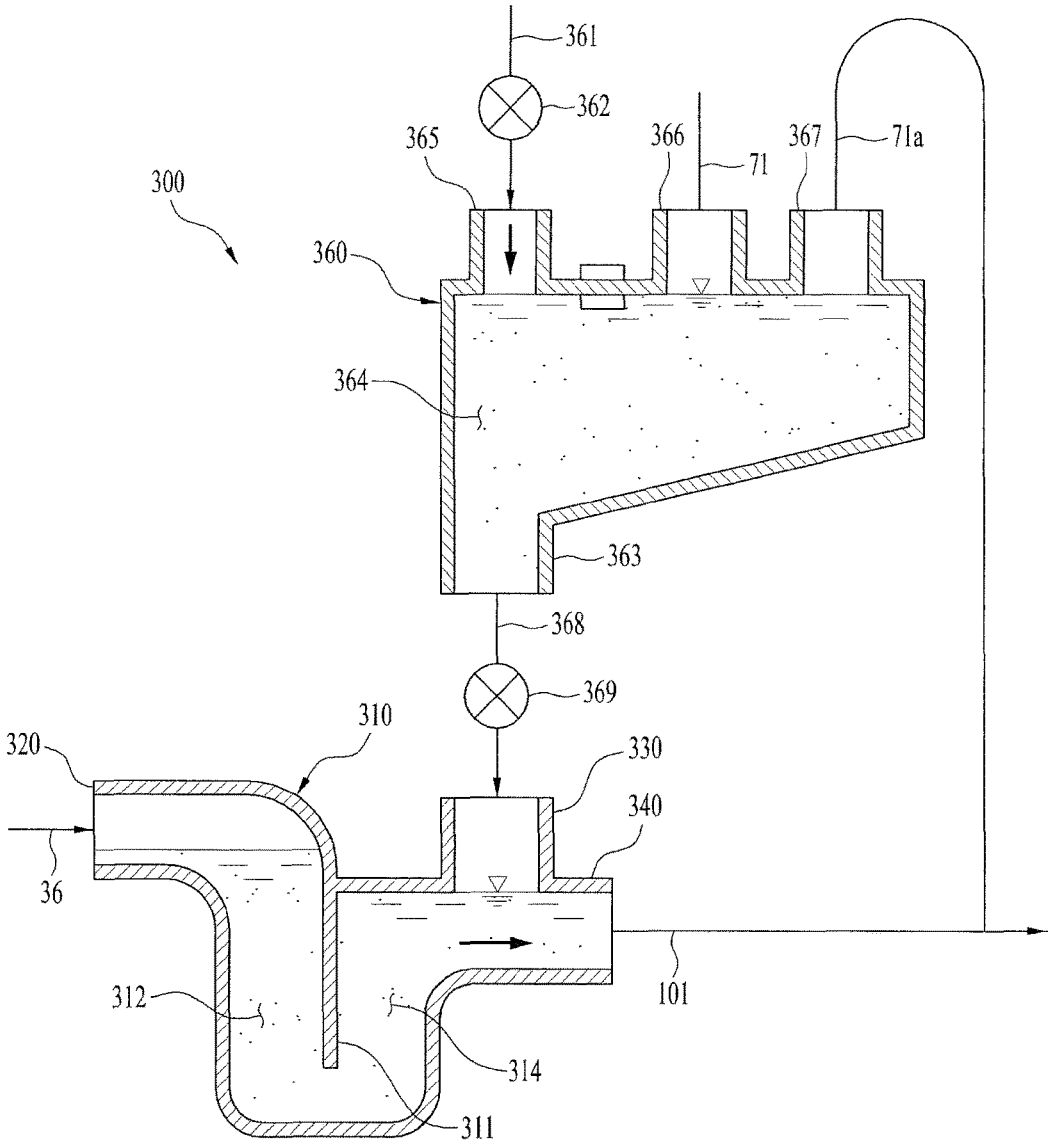
FIGS. 19 and 20 are schematic views of example discharge units in a food waste treatment apparatus.
Figure 20:
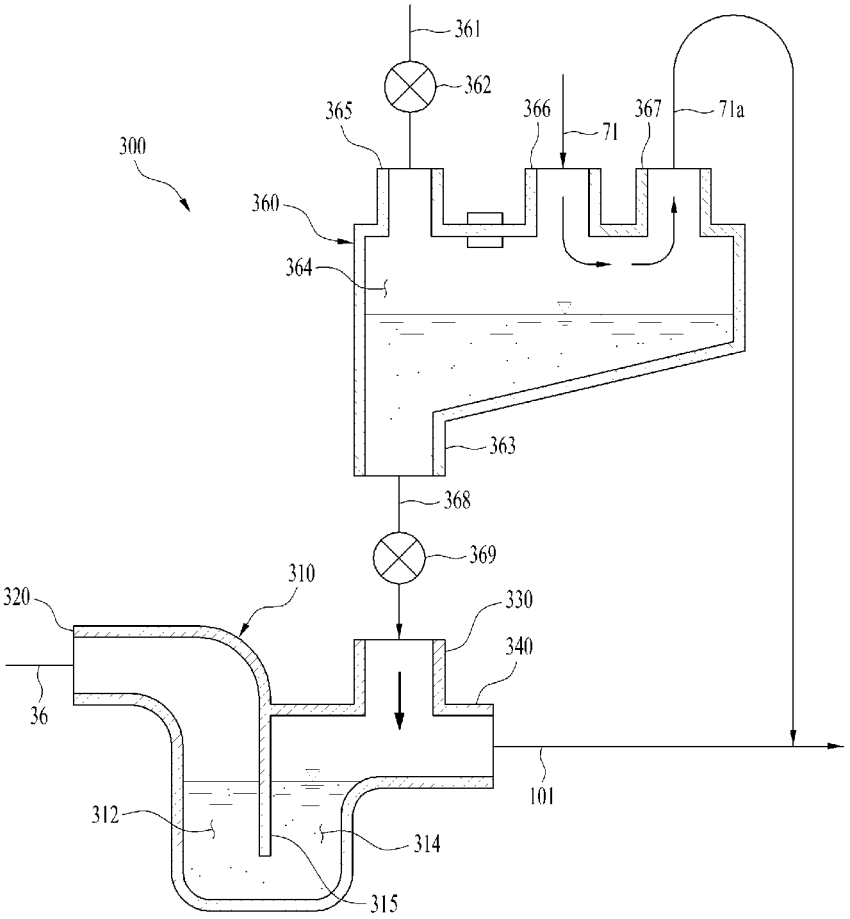

FIGS. 19 and 20 illustrate examples of a discharge unit in the food waste treatment apparatus.

As illustrated in FIG. 19, the discharge unit 300 includes a shielding chamber 360 provided at the exhaust duct 71, through which air discharged from the food waste treatment apparatus 100*a* moves, the shielding chamber 360 serving to actively control the air movement path, and a discharge body 310 internally defining a space for temporary storage and passage of water discharged from the food waste treatment apparatus 100*a* and air having passed through the shielding chamber 360.

Here, the shielding chamber 360 serves to control air exhausted from the exhaust duct 71 of the food waste treatment apparatus 100*a* so as to be selectively directed to the sewage flow path or the discharge unit 300.

The inner space of the shielding chamber 360 defines a space 364 that will be filled with water or allows movement of introduced air. The shielding chamber 360 is provided at the top thereof with a water supply port 365 to which a water supply pipe 361 is connected to supply water to the shielding chamber 360. The shielding chamber 360 is further provided at the bottom thereof with an outlet port 363, to which a second drain pipe 368 connected to the discharge unit 300 is connected to discharge the water filled in the shielding chamber 360.

Here, the water supply pipe 361 connected to the water supply port 365 of the shielding chamber 360 is provided with a water supply valve 362 for control of water to be supplied to the shielding chamber 360. The second drain pipe 368 connected to the outlet port 363 of the shielding chamber 360 is provided with a drain valve 369 to control the drainage of water stored in the shielding chamber 360.

Meanwhile, an exhaust air inlet port 366 for connection of the exhaust duct 71 of the food waste treatment apparatus 100*a* is formed at one side of the top of the shielding chamber 360 and an exhaust air outlet port 367 is formed next to the exhaust air inlet port 366 to enable discharge of the air introduced into the shielding chamber 360 through the exhaust air inlet port 366. Here, the exhaust air inlet port 366 and the exhaust air outlet port 367 have the same height inside the shielding chamber 360. Meanwhile, the exhaust air outlet port 367 defines a separate flow path to guide the air moving through the exhaust air outlet port 367 to the sewage flow path.

A water level sensor 364*a* to sense the level of water stored in the shielding chamber 360 is installed to the inner ceiling surface of the shielding chamber 360. Here, the water level sensor 364*a* senses the height of water stored in the shielding chamber 360 that is higher than the height of the exhaust air inlet port 366 and the exhaust air outlet port 367. That is, the water level sensor 364*a* senses the water after the water shields the exhaust air inlet port 366 and the exhaust air outlet port 367 as the shielding chamber 360 is filled with the water. That is, the water level sensor 364*a* senses the level of water after the inner space of the shielding chamber 360 is filled with the water until the water shields the exhaust air inlet port 366 and the exhaust air outlet port 367 and then provides the sensed result to the controller.

The discharge unit 300 includes a discharge body 310 internally defining a space for temporary storage and passage of water and air and a partition 315 to divide the inner space of the discharge body 310 into a first space 312 and a second space 314 which are in communication with each other. Here, the lower end of the partition 315 and the inner bottom space of the discharge body 310 are spaced apart from each other by a predetermined distance to allow the water staying in the first space 312 to move to the second space 314.

Meanwhile, a first water inlet port 320 for introduction of water discharged from the food waste treatment apparatus 100*a* is located at one side of the first space 312 and a second water inlet port 330 for introduction of water discharged from the shielding chamber 360 is located at the top of the second space 314.

Here, a second drain pipe 368 connected to the exhaust air outlet port 367 of the shielding chamber 360 is connected to the second water inlet port 330. The drain valve 369 provided at the second drain pipe 368 causes the water stored in the shielding chamber 360 to be drained to the sewage flow path through the second water inlet port 330 and the discharge unit 300.

In addition, the second space 314 is provided at the other side thereof with an outlet port 350, through which the water, introduced into the first space 312 and having passed below the lower end of the partition 315, is discharged to the sewage flow path and, simultaneously, the water introduced from the second water inlet port 330 of the second space 314 is discharged to the sewage flow path. The plumbing 101 is installed to the outlet port 350 so as to extend to the sewage flow path.

Meanwhile, the bottom surface of the discharge body 310 and the lower end of the partition 315 are spaced apart from each other by a predetermined distance. This provides a space for movement of the water from the first space 312 to the second space 314. The lower end of the partition 315 continuously remains submerged in the water staying in the first space 312 and the second space 314. This serves to prevent the backflow of foul odors of the sewage flow path through the outlet port 350 of the second space 314.

Accordingly, the first water inlet port 320 of the first space 312, the outlet port 350 of the second space 314, and the lower end of the partition 315 need to have different heights. That is, the height of the outlet port 350 may be lower than the height of the first water inlet port 320. The height of the lower end of the partition 315 may be between the height of the first water inlet port 320 and the height of the outlet port 350.

Hereinafter, operation of the discharge unit 300 will be described.

First, the case where water and air are discharged simultaneously from the food waste treatment apparatus 100*a* will be described with reference to FIG. 19.

As illustrated in FIG. 19, in the case where water is discharged through the drain pipe 36 of the food waste treatment apparatus 100*a* according to operation of the food waste treatment apparatus 100*a*, the discharged water is introduced into the first water inlet port 120 through the drain pipe 36 and supplied to the first space 312 of the discharge body 310 of the discharge unit 300.

Here, the water supplied to the first space 312 moves to the second space 314 through the space below the partition 315 that separates the first space 312 and the second space 314 from each other, thus causing the level of water to gradually rise from the bottom of the first and second spaces 312 and 314. As such, when the level of water reaches the height of the outlet port 350 of the second space 314, the water introduced into the first water inlet port 320 of the first space 312 is discharged to the sewage flow path through the outlet port 350 of the second space 314.

Here, the movement of air discharged from the food waste treatment apparatus 100*a* is limited by the shielding chamber 360. That is, water is supplied to the shielding chamber 360 and stored in the inner space of the shielding chamber 360 while the water of the food waste treatment apparatus 100*a* is drained through the discharge unit 300. The stored water blocks the exhaust air inlet port 366 and the exhaust outlet port 367, thereby limiting the movement of air.

Specifically, as drainage of the water generated in the food waste treatment apparatus 100*a* begins, the controller controls the water supply valve 362 provided at the water supply pipe 361 of the shielding chamber 360 to supply water to the shielding chamber 360. As the water is supplied to the shielding chamber 360, the water level sensor 364*a* senses the water. At a position where the water level sensor 364*a* senses the water, the water comes into contact with the lowermost portions of the exhaust air inlet port 366 and the exhaust air outlet port 367 so as to block the exhaust air inlet port 366 and the exhaust air outlet port 367. Thereby, the shielding chamber 360 continuously blocks a movement path of air in the exhaust duct 71 of the food waste treatment apparatus 100*a*.

Meanwhile, the case where air is discharged from the food waste treatment apparatus 100*a* will be described below with reference to FIG. 20.

As illustrated in FIG. 20, during the drying step of the food waste treatment apparatus 100*a* or when the food waste treatment apparatus 100*a* is not operated, a predetermined amount of water remains in an accumulated state in the first and second spaces 312 and 314 of the discharge unit 300. At this time, the amount of water accumulated in the first and second spaces 312 and 314 is kept at the height of the outlet port 350 of the second space 314. As the level of water is kept at the height of the outlet port 350, the lower end of the partition 315 remains submerged in the water. Thus, the first space 312 and the second space 314 remain separated from each other by the partition 315.

In some implementations, when backflow of air of the sewage flow path connected to the outlet port 350 of the second space 314 occurs, the partition 315 that separates the first space 312 and the second space 314 from each other prevents the air introduced into the second space 314 from flowing backward to the first space 312.

Meanwhile, the controller discharges the water stored in the shielding chamber 360 to the discharge unit 300 in order to assure exhaust of the air through the shielding chamber 360. Specifically, the controller opens the drain valve 369 of the second drain pipe 368 that connects the exhaust air outlet port 367 of the shielding chamber 360 and the second water inlet port 330 of the discharge body 310 to each other so as to drain some of the water inside the shielding chamber 360 to the discharge body 310. Thereby, as the water of the shielding chamber 360 is drained, the exhaust air inlet port 366 and the exhaust air outlet port 367 of the shielding chamber 360 are opened, causing the air introduced into the exhaust air inlet port 366 to move to and be exhausted from the exhaust air outlet port 367.

As is apparent from the above description, a food waste treatment apparatus may be capable of grinding, dehydrating and drying food waste and include a discharge unit.

In addition, the a food waste treatment apparatus may employ a dryer and a drying method for removing a great quantity of moisture contained in ground food waste and include a discharge unit.

In addition, a food waste treatment apparatus may be capable of preventing air, discharged after drying food waste, from flowing backward, thereby preventing user discomfort and include a discharge unit.

What is claimed is:

1. A food waste treatment apparatus comprising:

a housing, that includes a cylindrical housing body that is configured to be oriented parallel with the ground upon installation, that defines a space that is configured to dehydrate and dry food waste, that includes a drain pipe that is configured to discharge water included in food waste, that includes an exhaust duct that is configured to exhaust air that dried food waste, that defines an inlet port that is configured to guide food waste discharged from a grinder to the cylindrical housing body, and that defines an outlet port that is configured to discharge food waste that has been dehydrated and dried;

a storage body that is rotatably installed in the housing, the storage body having a communication hole that is configured to connect with the inlet port for receiving food waste or the outlet port for discharging food waste based on an orientation of the storage body;

an agitator that is located in the storage body, that is configured to rotate independent of the storage body, that is configured to open and close the communication hole of the storage body, and that is configured to agitate food waste by rotating in a dehydrator;

a dryer that is configured to dry food waste by supplying dry air to the housing; and an exhaust unit connected to the drain pipe and the exhaust duct, the exhaust unit being configured to prevent the air exhausted from the exhaust duct from flowing back into the drain pipe.

2. The apparatus according to claim 1, wherein the exhaust unit includes:

an exhaust body that defines a space that is configured to allow air and water to pass through the exhaust body; and a partition configured to divide the space of the exhaust body into a first space and a second space, the partition defining a gap that is configured to allow water to flow below the partition.

3. The apparatus according to claim 2, wherein the second space includes an air inlet port that is located at a top of the second space and is configured to connect to the exhaust duct.

4. The apparatus according to claim 2, wherein:

the first space includes a water inlet port that is configured to connect to the drain pipe, and the second space includes an outlet port that is configured to discharge water, the water inlet port being located at a higher position relative to the gap than the outlet port.

5. The apparatus according to claim 4, wherein an air inlet port is located above the outlet port and is configured to be blocked from allowing air to pass to the outlet port based on water being in the second space.

6. The apparatus according to claim 5, wherein the exhaust duct includes a check valve that is configured to prevent air moving through the exhaust duct from flowing back through an inlet of the exhaust duct.

7. The apparatus according to claim 5, wherein the exhaust duct includes a shielding chamber that is configured to block a flow path of air exhausted through the exhaust duct by supplying additional water to the shielding chamber.

8. The apparatus according to claim 7, wherein:

the shielding chamber includes a water supply pipe that is configured to supply water to the shielding chamber, a second drain pipe that is configured to guide water in the shielding chamber to the drain pipe, and a drain valve that is connected to the second drain pipe and is configured to control the second drain pipe, the exhaust duct and the second drain pipe are located at a top of the shielding chamber, and the exhaust duct and the second drain pipe are configured to be blocked based on water being in the shielding chamber.

9. The apparatus according to claim 8, wherein the shielding chamber includes a water level sensor located at the top of the shielding chamber.

10. The apparatus according to claim 8, wherein a bottom of the shielding chamber is sloped towards the second drain pipe.

11. The apparatus according to claim 1, wherein the exhaust duct includes a check valve that is configured to prevent air moving through the exhaust duct from flowing back through an inlet of the exhaust duct.

12. The apparatus according to claim 1, wherein the:

grinder is located between a drain of a sink and the housing, is configured to grind food waste and provide food waste to the housing, and includes:

a support body that includes an introduction side that is configured to receive food waste and a discharge side that is configured to discharge food waste to the housing; and a pair of rotary cutters that is rotatably installed to the support body, the pair of rotary cutters being configured to grind food waste received through the introduction side and to move food waste to the discharge side.

13. The apparatus according to claim 1, further comprising a drive unit that is configured to rotate the agitator in a clockwise direction and a counterclockwise direction, wherein the storage body rotates along with the agitator based on the agitator being rotated in one direction among the clockwise direction and the counterclockwise direction.

14. The apparatus according to claim 1, wherein the agitator includes:

a base that is located inside the storage body and that is configured to rotate;

a door blade extending from an outer circumferential surface of the base along the inside of the storage body, the door blade being configured to open or close the communication hole based upon an orientation the base and to agitate food waste in the storage body; and a plurality of agitation blades that are spaced apart from the door blade by a predetermined distance, extend along the inside of the storage body, and are configured to agitate food waste in the storage body based on rotation of the base.

15. The apparatus according to claim 14, wherein:

the door blade includes a scraper that is configured to scrape food waste from the storage body, and each agitation blade includes one or more bosses.

16. The apparatus according to claim 1, further comprising:

a housing door that is located on the housing body and configured to selectively open or close the outlet port; and a drawer that is configured to retract from the housing, the drawer defining a space that is configured to store food waste discharged from the outlet port.

* * * * *